US011701296B2

(12) United States Patent
Oaks et al.

(10) Patent No.: US 11,701,296 B2
(45) **Date of Patent: *Jul. 18, 2023**

(54) REMOTE MODULAR SYSTEM AND METHOD FOR DELIVERING CPR COMPRESSION

(71) Applicant: The Government of the United States of America, as represented by the Secretary of Homeland Security, Washington, DC (US)

(72) Inventors: Tristan Oaks, Arlington, VA (US); Wesley Russell, Washington, DC (US); Sadie Simons, Ware, MA (US); Breanna Wood, Milton, FL (US); Michael Plumley, Groton, CT (US); Ronald Adrezin, East Lyme, CT (US)

(73) Assignee: The Government of the United States of America, as represented by the Secretary of Homeland Security, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/096,124

(22) Filed: Jan. 12, 2023

(65) Prior Publication Data

US 2023/0157926 A1 May 25, 2023

Related U.S. Application Data

(63) Continuation of application No. 17/667,325, filed on Feb. 8, 2022, now Pat. No. 11,607,368.

(Continued)

(51) Int. Cl.
*A61H 31/00* (2006.01)

(52) U.S. Cl.
CPC ..... *A61H 31/006* (2013.01); *A61H 31/004* (2013.01); *A61H 2201/0103* (2013.01);

(Continued)

(58) Field of Classification Search
CPC ..... A61H 31/006; A61H 2201/0103; A61H 2201/0107; A61H 2201/0157;

(Continued)

(56) References Cited

U.S. PATENT DOCUMENTS 4,349,015 A * 9/1982 Alferness ..... A61H 9/0078 128/205.16
4,424,806 A * 1/1984 Newman ..... A61H 9/0078 128/205.25

(Continued)

*Primary Examiner* — Justine R Yu
*Assistant Examiner* — Benjamin M. Kusiak
(74) *Attorney, Agent, or Firm* — Lavanya Ratnam; Robert W. Busby; Kelly G. Hyndman

(57) ABSTRACT

A method for cardiopulmonary resuscitation (CPR) includes supplying an inflation gas at an operative pressure to an inflation actuated soft gripper device to change form from an undeployed state to a deployed grip state that accommodates and grips a human torso. The inflation actuated soft gripper device includes a first inflatable gripper arm having a first distal end and a second inflatable gripper arm having a second distal end. The first distal end and the second distal end approach one another from the undeployed state to the deployed grip state. The first and second distal ends are spaced apart from one another further in the undeployed state than in the deployed grip state. An actuator power and a CPR control signal are delivered to a CPR pressure application device to cyclically extend and retract a pressure applicator along an axis in alignment with a sternum of the human torso.

21 Claims, 19 Drawing Sheets

Related U.S. Application Data

(60) Provisional application No. 63/171,707, filed on Apr. 7, 2021.

(52) U.S. Cl.
CPC ..... *A61H 2201/0107* (2013.01); *A61H 2201/0157* (2013.01); *A61H 2201/1215* (2013.01); *A61H 2201/149* (2013.01); *A61H 2201/1621* (2013.01); *A61H 2201/1647* (2013.01); *A61H 2201/1664* (2013.01); *A61H 2201/5015* (2013.01); *A61H 2201/5025* (2013.01); *A61H 2201/5043* (2013.01); *A61H 2201/5097* (2013.01); *A61H 2205/084* (2013.01)

(58) Field of Classification Search
CPC ..... A61H 2201/1215; A61H 23/02; A61H 23/0254; A61H 31/004; A61H 2203/0456; A61H 2205/083; A61H 2205/084; A61H 2201/0161; A61H 2201/1207; A61H 2201/149; A61H 2201/1619; A61H 2201/1621; A61H 2201/1645; A61H 2201/1647; A61H 2201/1664; A61H 2201/5007; A61H 2201/501; A61H 2201/5015; A61H 2201/5025; A61H 2201/5043; A61H 2201/5097; A61H 31/00; A61H 31/005; A61H 31/007; A61H 31/008; A61H 2031/001; A61H 2031/003; A61H 9/00–0007; A61H 9/005; A61H 9/0078; A61H 9/0092; A61F 5/012; A61F 5/05816
USPC ..... 601/41; 602/13
See application file for complete search history.

(56) References Cited

U.S. PATENT DOCUMENTS

| | | | | |
|---|---|---|---|---|
| 5,399,148 | A * | 3/1995 | Waide | A61H 31/006 601/106 |
| 7,517,328 | B2 * | 4/2009 | Hoffmann | A61H 31/00 601/48 |
| 2002/0007132 | A1 * | 1/2002 | Rothman | A61H 9/0078 601/41 |
| 2010/0004571 | A1 * | 1/2010 | Nilsson | A61H 31/006 601/41 |
| 2010/0063425 | A1 * | 3/2010 | King | A61H 31/008 248/176.1 |
| 2010/0326442 | A1 * | 12/2010 | Hamilton | A61M 16/209 601/41 |
| 2011/0201980 | A1 * | 8/2011 | Reitan | A61F 5/03 601/41 |
| 2014/0088467 | A1 * | 3/2014 | Parascandola | A61H 31/006 601/41 |
| 2016/0143804 | A1 * | 5/2016 | Nilsson | A61H 31/006 601/41 |
| 2016/0158096 | A1 * | 6/2016 | Godfrey | A61H 23/0263 601/72 |
| 2017/0319343 | A1 * | 11/2017 | Zotz | A61M 60/554 |
| 2017/0333280 | A1 * | 11/2017 | Black | A61H 7/005 |
| 2018/0361596 | A1 * | 12/2018 | Beri | B25J 15/0023 |
| 2019/0175443 | A1 * | 6/2019 | Härdig | A61H 31/005 |
| 2019/0209428 | A1 * | 7/2019 | Paradis | A61H 31/007 |
| 2019/0321256 | A1 * | 10/2019 | Krewson | A61H 1/00 |
| 2021/0085899 | A1 * | 3/2021 | Taylor | A61M 16/0009 |
| 2021/0330547 | A1 * | 10/2021 | Moaddeb | A61N 1/0456 |

* cited by examiner

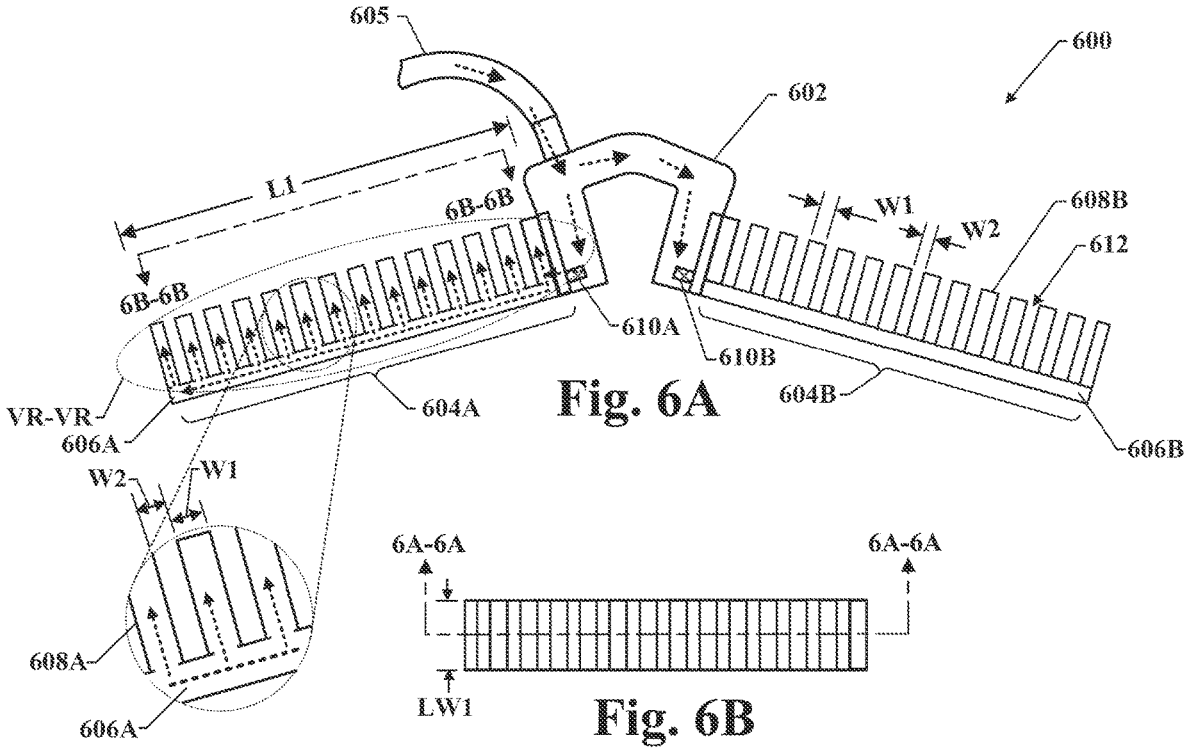
Fig. 6A
Fig. 6B
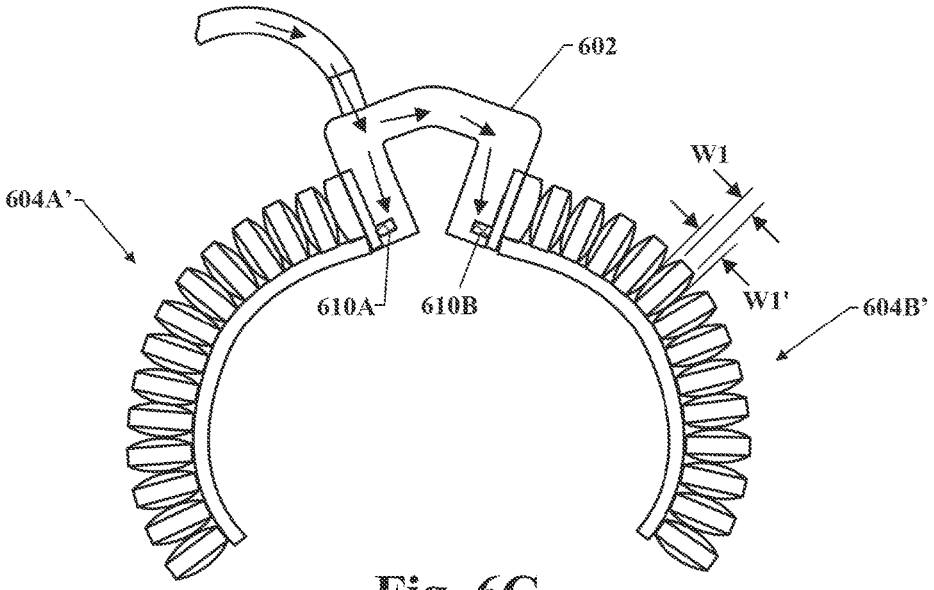
Fig. 6C

Fig. 14A
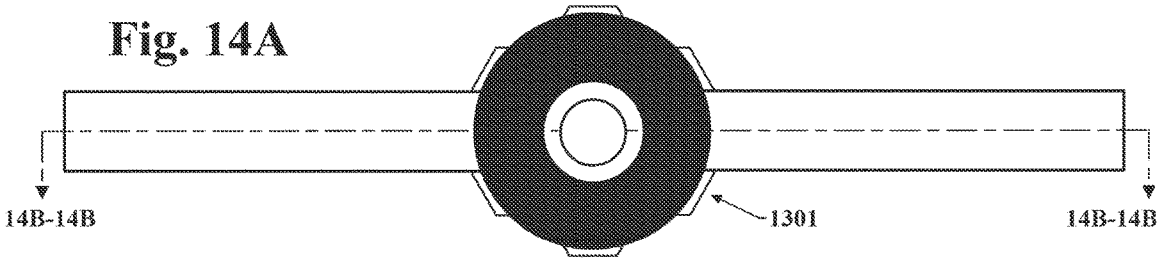
Fig. 14B
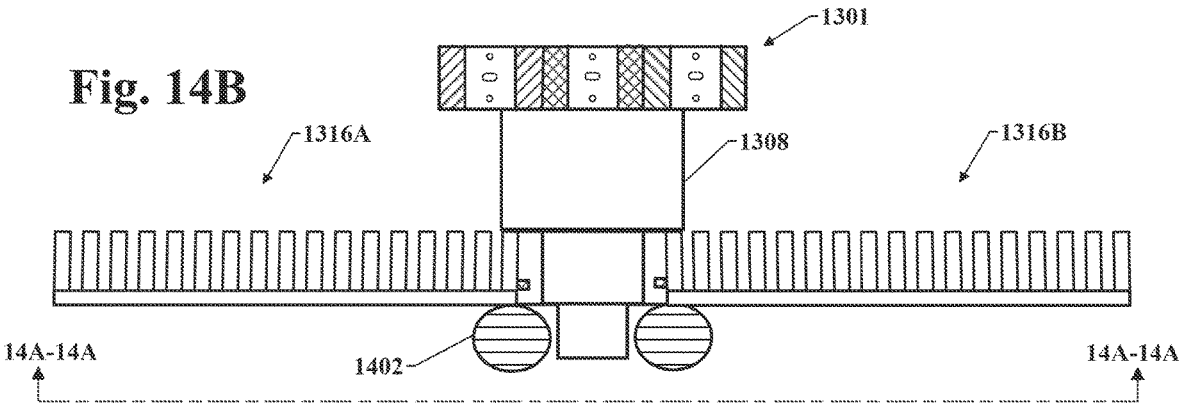
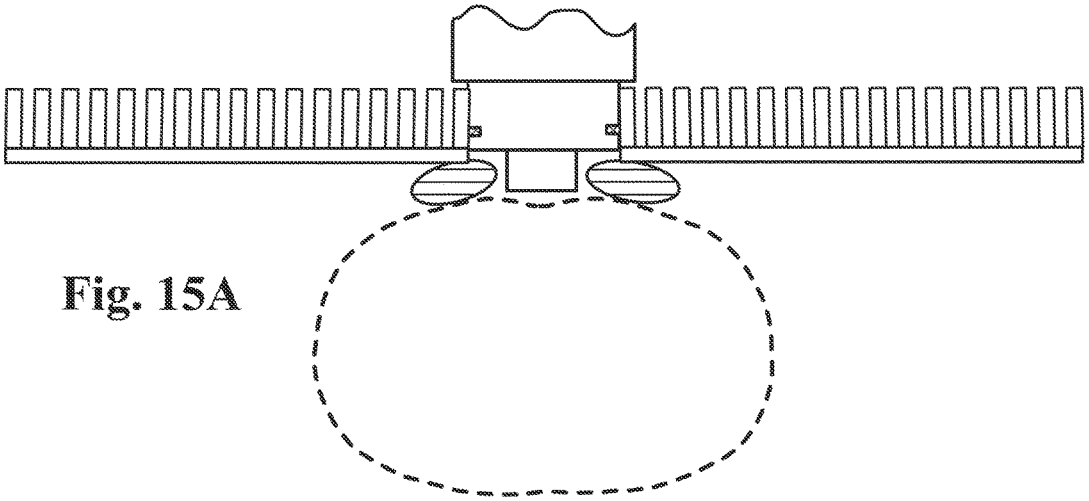
Fig. 15A

REMOTE MODULAR SYSTEM AND METHOD FOR DELIVERING CPR COMPRESSION

CROSS-REFERENCE TO RELATED APPLICATIONS

This application is a continuation of U.S. patent application Ser. No. 17/667,325, filed on Feb. 8, 2022, entitled REMOTE MODULAR SYSTEM FOR DELIVERING CPR COMPRESSION, which is a nonprovisional of and claims the benefit of priority from U.S. Provisional Patent Application No. 63/171,707, filed on Apr. 7, 2021, entitled REMOTE MODULAR SYSTEM FOR DELIVERING CPR COMPRESSION, the entire disclosures of each are incorporated herein by reference.

STATEMENT OF GOVERNMENT INTEREST

The present invention was made by employees of the United States Department of Homeland Security in the performance of their official duties. The U.S. Government has certain rights in this invention.

FIELD

Embodiments disclosed herein generally relate to cardiopulmonary resuscitation (CPR).

BACKGROUND

In battlefield situations, personnel can receive injuries necessitating immediate application of CPR. Applying CPR, though, can put medical personnel at risk. There are current systems directed to machine applied CPR, e.g., automatic, machine exerted compression-release downward-upward displacement of a surface of a subject's chest, e.g., aligned with the subject's sternum. The machine applied CPR can provide significant advantages, statistically, over human-applied CPR. Such advantages can include automatic control of the magnitude, displacement, and periodicity of the force to most likely effect an appropriate contraction-expansion of the subject's heart chambers for forcing a certain blood flow within the subject. Current systems, though, can require medical personnel to exert significant effort, and incur substantial risk from exposure while doing so. Such efforts can include lifting the subject into and properly positioning the subject within a space above a supporting backboard and under an automatic CPR compression applicator attached above the backboard.

SUMMARY

In an embodiment, an example portable system for cardiopulmonary resuscitation (CPR) of a human can include a frame, an inflation actuated soft gripper device, supported by the frame, configured to receive an inflation gas at an operative pressure and, in response, change form to a deployed grip state that accommodates and grips a human torso. The example portable system for CPR of a human can include a pressure applicator device, which can be configured to receive an actuator power and a CPR control signal and, in response, concurrent with the deployed grip state, cyclically extend and retract a pressure applicator, along an axis. The example portable system for CPR of a human can include the CPR pressure applicator device being supported by the frame in a configuration enabling alignment of the axis with a sternum of the human torso.

In another embodiment, an example portable modular system for CPR of a human can include a first module hub housing and, removably attached to the first hub housing, a second module hub housing, and an inflation actuated soft gripper device, supported by the first module hub housing, configured to receive an inflation gas at an operative pressure and, in response, change form to a deployed grip state that accommodates and grips a human torso. The example portable modular system for CPR can also include a CPR pressure applicator device, supported by the second module hub housing, configured to receive an actuator power and a CPR control signal and, in response, concurrent with the deployed grip state, cyclically extend and retract a pressure applicator, in a movement along an axis, the axis being in an alignment with a sternum of the human torso.

In another embodiment, an example portable modular system for CPR of a human can include a housing, and an inflation actuated soft gripper, supported by the housing, configured to receive an inflation gas and, in response to inflation to an operative pressure, to change shape to a deployed grip state that accommodates and grips a human torso. The example portable modular system for CPR of a human can also include a CPR cycling pressure device, supported by the housing, configured to receive an actuator power and a CPR control signal and, in response, concurrent with the deployed grip state, actuate a reciprocating, cyclic CPR movement of a pressure applicator, along an axis in an alignment with a sternum of the human torso.

In another embodiment, an example portable modular system for CPR of a human can include a frame, an inflation actuated soft gripper, supported by the frame, having a non-inflated form state when not inflated and configured to respond to inflation by an inflation gas to an operative pressure, by changing from the non-inflated form state to deployed grip form state, the deployed grip form state having a configuration that extends around and grips a human torso. The example portable modular system for CPR of a human can include a CPR cycling pressure device, supported by the housing, configured to receive an actuator power and a CPR control signal and, in response, concurrent with the deployed grip form state, actuate a CPR movement of a pressure applicator, along an axis in an alignment with a sternum of the human torso.

Other features and aspects of various embodiments will be understood from reading the following detailed description in conjunction with the accompanying drawings. This summary is not intended to identify key or essential features, or to limit the scope of the invention, which is defined solely by the claims.

BRIEF DESCRIPTION OF THE DRAWINGS

FIG. 6A is a partial cutaway front projection view of a non-inflated state of an example gas inflation deployable soft gripper device, for remote modular CPR systems in accordance with one or more embodiments; FIG. 6B is a cross-cut projection view of certain structure of the FIG. 6A gas inflation deployable soft gripper device, as visible on FIG. 6A cross-cut projection plane 6B-6B; and FIG. 6C is a projection view, on the same projection as FIG. 6A, showing an inflated, fully deployed state of the FIG. 6A implementation.

FIG. 10A shows a cross-sectional view, on FIG. 9A projection 10A-10A, and FIG. 10B shows a cross-sectional view, on FIG. 9B projection 10B-10B.

FIG. 14A is a projection view of the FIG. 13A-13B example implementation of a modular remote CPR system according to another embodiment, on the FIG. 13B projection 14A-14A, with an added cushion device, and on the FIG. 14B projection 14A-14A; FIG. 14B is a cross-cut projection view, on the FIG. 14A cross-cut plane 14B-14B.

FIGS. 15A-15E are projection views, on the FIG. 14A cross-cut plane 14B-14B, of a snapshot sequence of operative states of the FIG. 13A-13B example implementation of a modular remote CPR system according to another embodiment, in a cycle within a CPR repeating cycle compression process.

DETAILED DESCRIPTION

Figure 1A:
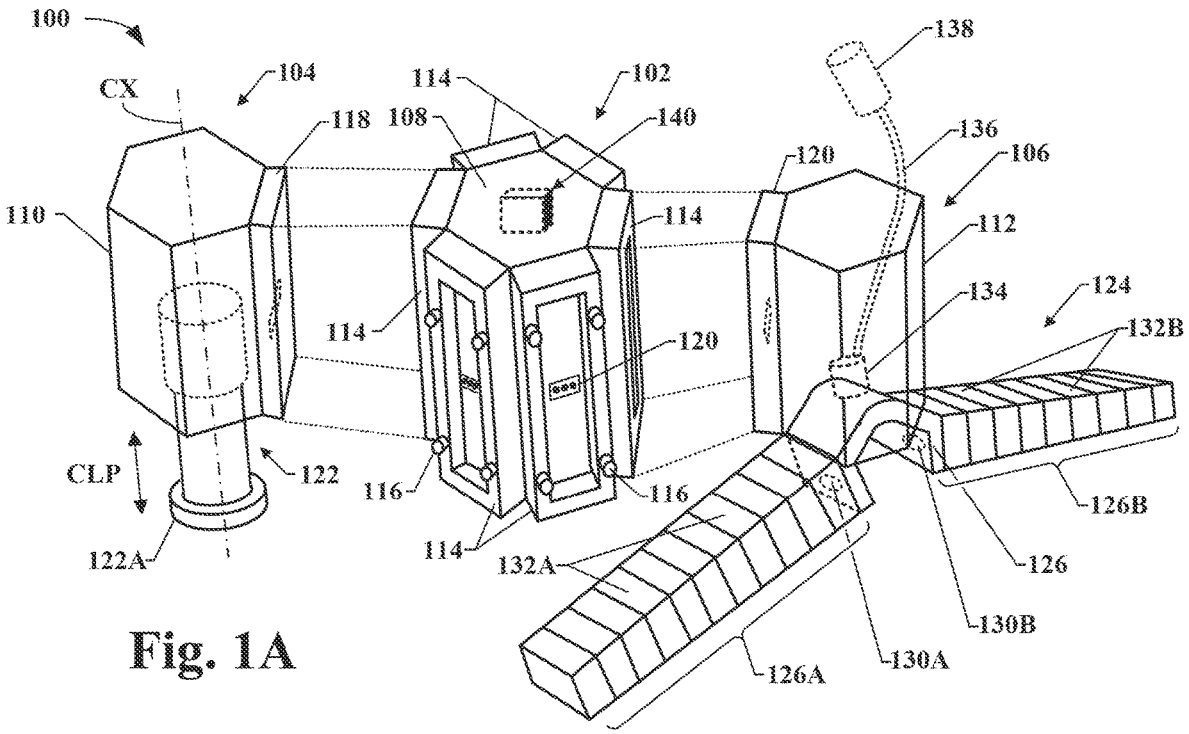
FIG. 1A shows a perspective view of a partial disassembly of an example remote modular cardio-pulmonary resuscitation (CPR) system according to one or more embodiments, including a main hub, attachable to a hub carrying a CPR pressure applicator module, and to a hub for a soft gripper module.

In the drawings, like reference numerals designate identical or corresponding parts throughout the several views. The drawings are generally not drawn to scale unless specified otherwise or illustrating schematic structures or flowcharts. As used herein, the words "a," "an" and the like generally carry a meaning of "one or more," unless stated otherwise. For brevity, "modular remote" is alternatively recited as "ML." It will be understood that "ML" as used herein has no intrinsic meaning; it is simply a reduced letter count recitation of "modular remote."

In an example application, one or more modular remote (ML) CPR systems according to an embodiment can be assembled, e.g., at a staging area, by simple, no tools required, attachment of a hub-configured soft gripper module to a hub-configured CPR compression module. The assembled ML CPR system can include a controller, either as another attached hub or implemented in one or each of CPR compression module and soft gripper module. The controller can include life signs monitor functions. The system can be operated by one person A system according to one or more embodiments can include a soft gripper module implemented on a first hub and a CPR pressure application module implemented on a second hub. The soft gripper module can include a bladder support mounted to the first hub, and an inflatable bladder that can be secured to the bladder support. The inflatable bladder can include an inflation gas port that can be configured to receive and to route to an interior of the inflation bladder an inflation gas at an inflation pressure. The inflation gas can correspondingly change an interior surface pressure within the inflatable bladder. The inflatable bladder can be configured to extend, in a bilateral wrapping or pincer manner accommodating a human torso, in response to the interior surface pressure exceeding a threshold. The CPR pressure application module can include a second hub, which can be coupled to the first hub, and mounted to the second hub a CPR cyclic pressure driver that can in turn be coupled to a CPR pressure applicator. The CPR pressure applicator can include a contact surface configured, e.g., have a surface area and contour, for contacting a human chest. The CPR cyclic pressure driver can be configured to cyclically extend and retract the CPR pressure applicator.

Example implementations of the CPR cyclical pressure driver are described in further detail in subsequent paragraphs.

The inflation gas can, for example, be compressed air that can be provided, e.g., by a portable compressed air tank. In an aspect, the compressed air tank can be implemented as an inflation gas module, e.g., as a compressed air canister within another attachment hub.

In the above-described implementation where the soft gripper module uses a first hub and the CPR pressure module uses a second hub, an embodiment can include the first hub as a main hub and the second hub as an attachment hub. An example implementation according to this embodiment is described in greater detail in reference to FIG. 2A. In example alternative implementation according to this embodiment, the second hub can be a main hub and the first hub can be an attachment hub. An example of this implementation is described in more detail later, for example, in reference to FIG. 2B. According to one or more embodiments, a main hub may be provided with functionality other than an inflation actuated soft gripper module and other than the CPR pressure module. In an embodiment, the main hub can be configured with functionalities including, for example, but not limited to computer-based control, or user interface. In an implementation according to this embodiment, a CPR pressure module can be configured on a first attachment hub and a CPR pressure module configured on a second attachment hub, and a system according to various embodiments can be readily assembled by attaching the first attachment hub and the second attachment hub to the main hub. An example implementation according to this embodiment is described in more detail later, for example, in reference to FIG. 1A and FIG. 1B.

Various embodiments' technical feature of main hub—attachment hub provides numerous secondary features. One is enablement of field-configurable combinations of attachments, and spare attachments. Another is ease of field repair, e.g., when a component becomes contaminated and needs to be replaced. Still another is a ready availability of different sized tools, for example, for patients of various builds. Another of the provided features is adaptability, e.g., via attachment of new components or sensors, to perform a task additional to or other than CPR.

In one or more implementations the main hub can include a main hub housing. The main hub housing can include a main hub perimeter face or can include a plurality of main hub perimeter faces. The main hub housing can be implemented as a main hub polygon housing, for example, a main hub hexagonal housing. One or more implementations can provide or incorporate a stub and tube configuration. Features of a stub and tube configuration can include, but are not limited to, enablement of ready attachment and detachment of, for example, an assortment of different types of attachment hubs. The stub-and-tube configuration can include a hub-to-hub connection system that can be structured to provide, in an aspect, an interference fit. The connection system can configure the interference fit as a firm, friction-based connection between two parts without the use of an additional fastener.

In an aspect, tubes in the main hub can house one end of a connector, e.g., a female end of a USB-C, configured to can attach with a corresponding end, e.g., a male end of a USB-C, housed in the stub on the attachment hubs. Secondary technical features of this connection system include, for example and without limitation, allowance of the main hub to communicate with the specific attachment that it is connected to.

In an implementation, one or more of the faces of the main hub housing can include a hub-to-hub receiving and attachment structure, and the attachment hubs can include a corresponding attachment housing hub-to-hub engagement and attachment structure. The hub-to-hub engagement and attachment structure can be configured to align with, engage and attach to the hub-to-hub receiving and attachment structure of the main hub. In an aspect, the above-described connector ends can be configured to removably connect to the main hub communication cable connector in association with an engagement and attachment of the hub-to-hub engagement and attachment structure to the hub-to-hub receiving and attachment structure.

In one example implementation, the hub-to-hub receiving and attachment structures, or hub-to-hub engagement and attachment structures, or both, can include magnets that can that guide the main hub and attachment hub together and provide additional force to keep the two hubs together. One example can include two neodymium magnets that guide the main hub and attachment hub together and provide additional force to keep the two components together.

Embodiments can provide, through their modular architecture and structural features in accordance with this disclosure, a scalable robotics soft gripper that can grasp a victim or other subject, e.g., a test person, (hereinafter, collectively, "subject") by or around the sides of the subject's body, with gripping force and gripping structure sufficient to stabilize the system while administering the CPR compression. In description of embodiments, "stabilize" can encompass, for example, stabilizing the CPR pressure module against excess movement relative to the subject's body, e.g., movement due to reactive force against the CPR pressure module, opposite the CPR compression force the CPR pressure module applies to the subject. It will be understood that "by or around the sides," as used herein in describing embodiments, except where indicated explicitly or by context to be otherwise, encompasses by pressure on or against the subject's lateral sides, by pressure on or against portions of the subject's lateral sides and peripheral areas of the subject's back.

Various features of the modular remote CPR system according to various embodiments are as described in more detail in paragraphs and, as will be understood by persons of ordinary skill in the pertinent arts upon reading this disclosure, include but are not limited to mechanically secure attachment through, low cost, low complexity, durable, cooperative attachment structures. Features and benefits also include, modular configurability, and light weight, which can provide further benefits, such as a CPR system that can be easily brought to and rapidly utilized in a not fully controlled environment. Further features include, as provided by various structural features of the gas inflation actuated soft gripping module, a strong yet soft grasping force, as described in more detail in later sections of this disclosure.

Figure 1B:
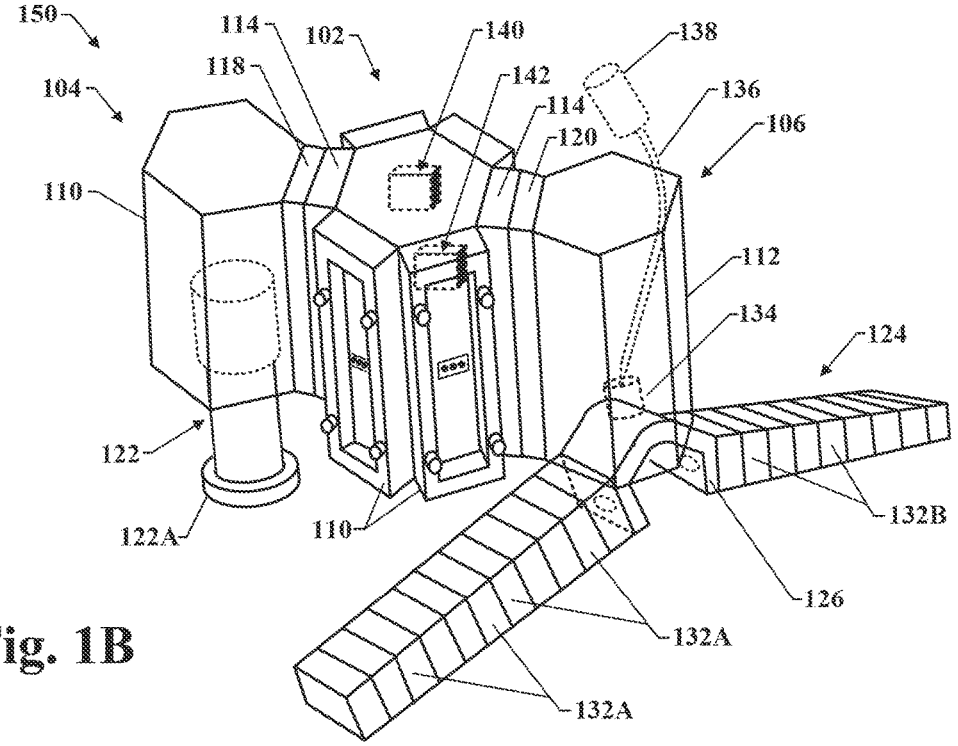
FIG. 1B shows the assembled system 150.

FIG. 1A shows a perspective, "exploded view" state 100 of a system 100 of one example implementation of a three-module remote modular system for applying CPR compression according to one or more embodiments. FIG. 1A shows the set of three modules in an arrangement, with dotted connection lines indicative of their intended assembly. The three modules are reversibly attachable to one another to form an operational, portable as assembled, remote modular system for delivering CPR compression. FIG. 1B shows a perspective view of the assembly, providing a modular system for remote CPR system according to one or more embodiments.

The FIG. 1A set of mutually attachable modules includes a main hub module 102 according to an embodiment, a CPR cyclical pressure applicator module 104 according to an embodiment, and a gas inflation actuated soft gripper module 106. For purposes of description, the FIG. 1B assembled, operational state system, functionality features of the system modules, and various structural features of the systems modules, including cooperative mutual attachment structures, are collectively referenced as a "modular remote (ML) cardio-pulmonary resuscitation (CPR) system," which will be interchangeably recited as "modular remote CPR system" and "ML CPR system."

In an embodiment, the main hub module 102 can include a main hub housing 108, the CPR cyclical pressure applicator module 104 can include, e.g., can be structured with components mounted to, a first attachment hub housing 110, and the gas inflation actuated soft gripper module 106 can include, e.g., can be structured with components secured to a second attachment hub housing 112. As described in more detail later in this disclosure, e.g., in reference to FIG. 4, the attachment hub housings can be identically configured, e.g., as instances of a generic hexagon attachment hub housing. In such implementation, the first attachment hub housing 110 and the second attachment bub housing 112 can be, respectively a first hexagon attachment hub housing and a second hexagon attachment hub housing. In the implementation, the first hexagon attachment hub housing includes six first attachment hub housing outer faces, and the second hexagon attachment hub housing includes six second attachment hub housing outer faces. In an embodiment, the first attachment hub housing 110 and the second attachment hub housing 112 can be identically configured, e.g., as instances of a generic attachment hub, as is described in more detail later in this disclosure.

In embodiment, as visible in FIGS. 1A and 1B, the main hub housing 108 can be configured as a three-dimensional hexagon that can provide six main hub housing outer faces, i.e., outer sides that can extend, for example, a housing height. In an embodiment, the main hub housing 108 can include, for example, on one or more of its six sides, a hub-to-hub receiving and attachment structure 114. The FIG. 1A example shows an instance of the hub-to-hub receiving and attachment structure 114 on each of the six sides, which provides technical benefits. These include, but are not limited to, enabling attachment of an attachment hub to each of the main hub housing 108 six sides. Technical benefits of a hub-to-hub receiving and attachment structure 114 on all six sides of the main hub housing 108 also include redundancy. As a specific example, notwithstanding reliability and durability benefits of the FIG. 1A hub-to-hub receiving and attachment structure 114 not requiring moving parts, e.g., requiring no latch movement, as described in more detail in later paragraphs, harsh conditions and rough handling can cause failure of one or more of the hub-to-hub receiving and attachment structure 114. However, it will be understood that an instance of the hub-to-hub receiving and attachment structure 114 on all sides of the main hub housing 108 is not a limitation. On the contrary, instances or portions of the hub-to-hub receiving and attachment structure 114 may be omitted from one or more of the housing sides.

An example implementation of the hub-to-hub receiving and attachment structure 114 can include a plurality of main hub housing magnets 116. The main hub housing magnets 116, in an embodiment, can be structured as protruding magnets, or can be embedded within non-magnetic protruding structures. In such embodiments, the engagement and attachment structures of hub housing of attachment modules, e.g., the engagement and attachment structures 118 of the hub housing 110 of the CPR cyclical pressure applicator module 104 and the engagement and attachment structures 120 of the housing 112 of the gas inflation actuated soft gripper module 106, can be configured with recesses or receptacles and, disposed in or proximal to the recesses or receptacles, can include corresponding magnets, which can be referenced as attachment hub housing magnets, with polarities oriented to attract the main hub housing magnets 116. The main hub housing magnets 116 and the attachment hub housing magnets can, in other words, have mutual alignment, and can have complementary polarity configurations to provide magnetic attractive coupling. The projection implementation of the main hub housing magnets 116 can, in a similar manner, be arranged to provide mutual alignment, locations matching locations of the attachment hub housing magnets, and vise-versa. Projections can therefore be complementary projections, in relation to receptacles formed in the attachment hub housings. Stated differently, the hub-to-hub receiving and attachment structure 114 and engagement and attachment structures 118 of the hub housing 110 of the CPR cyclical pressure applicator module 104 can be formed with cooperative mechanical structure, and structure 114 and the engagement and attachment structures 120 of the housing 112 of the gas inflation actuated soft gripper module 106. Also, for purposes of description, the hub-to-hub receiving and attachment structure 114, the engagement and attachment structure 118, and the engagement and attachment structure 120 can be collectively referenced as housing hub-to-hub attachment structure and as housing hub-to-hub attachment structures.

In an embodiment, the CPR cyclical pressure applicator module 104 can include a CPR pressure applicator element 122, which can be configured, e.g., structured to have cooperative mechanical interface with a movement guide, for movability aligned with a CPR pressure exertion axis such as the FIG. 1A visible axis labeled CX. As described in more detail in later sections, the movement can be urged by an actuator, which can in turn be controlled by an actuator control logic, such as the examples described in more detail in subsequent sections. The CPR pressure applicator element 122 can have a distal end 122A that, directly or through a pad or cushion can exert pressure cycles on a patient's chest with parameters that can cyclically compress and decompress the patient's heart, in a controlled, uninterrupted manner that can effectuate a corresponding flow of blood within the patient. In an embodiment, the CPR cyclical pressure applicator module 104 can include movement guide, described in more detail in later sections, which can support movement of the CPR pressure applicator element 122, urged by various actuator features also described later, in cyclically extending and retracting, along the CPR axis CLP (see FIGS. 7 and 8).

The gas inflation actuated soft gripper module 106 includes an air inflatable soft gripper 124, which can include a soft gripper arm connector hub 126 that can be secured, e.g., mounted, bolted, to the second attachment hub housing 112 on which or in which the gas inflation actuated soft gripper module 106 is implemented.

Shown in a non-inflated state, the air inflatable soft gripper 124 can include two air inflatable gripper arms, shown as a first air inflatable gripper arm126A and a second air inflatable gripper arm 126B that can connect to the soft gripper arm connector hub 126. As described in more detail later in this disclosure, the FIG. 1A implementation, the soft gripper arm connector hub 126 can be configured to enclose an interior volume and, within the interior volume, there can be a port or passage, such as the representative example first arm internal inflation port 130A and second arm internal inflation port 130B (collectively referenced as "internal inflation ports 130."). The internal inflation ports 130 can be configured to carry inflation gas, respectively, to an interior of the first air inflatable gripper arm 126A and interior of the second air inflatable gripper arm 126B. In an embodiment, via the interior volume of the soft gripper arm connector hub 126 can provide a plenum chamber for equalizing pressuring within the first air inflatable gripper arm 126A and the second air inflatable gripper arm 126B.

Figures 2A, 2B:
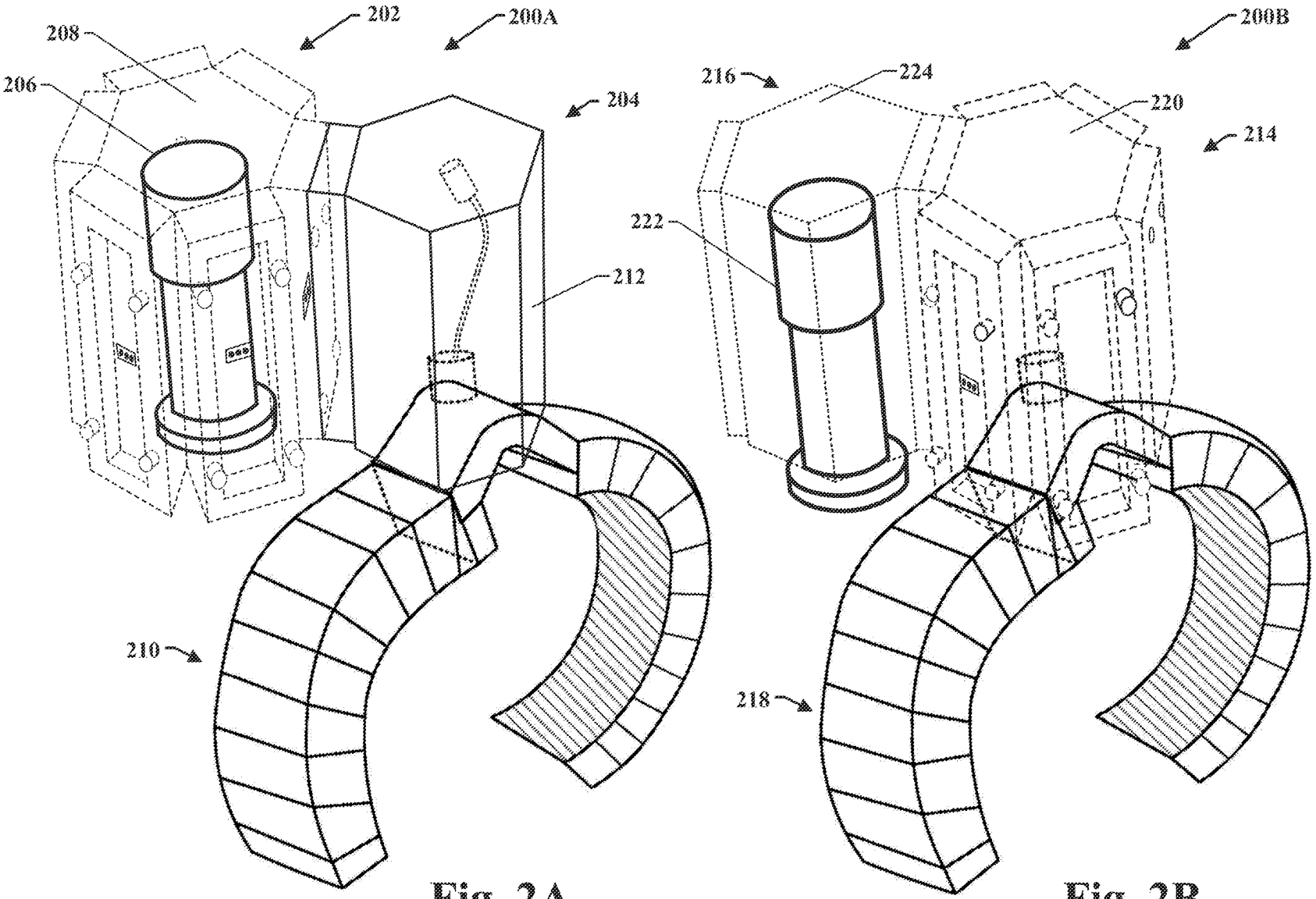
FIG. 2A shows a perspective view of an example remote modular CPR system according to another embodiment, featuring a main hub CPR pressure applicator module, removably attached to an attachment hub soft gripper module.
FIG. 2B shows a perspective view of an example remote modular CPR system according to still another embodiment, including a main hub implemented soft gripper module, removably attached to an attachment hub CPR pressure applicator module.

In an embodiment, the first air inflatable gripper arm 126A and the second air inflatable gripper arm 126B can include a plurality of individual gas-inflatable cells, such as the examples represented as first arm bladder cells 132A and second arm bladder cells 132B, collective referenced as "air bladder cells 132. In an embodiment, the air bladder cells 132 can be respectively shaped, and structured, to expand with a particular varying three-dimension form in response to activation gas. The expansion, and effects thereof can be obtained by assigning particular thicknesses and position-varying profiles of thickness to position. FIGS. 1A and 1B show indication of such bladder cells, e.g., first arm bladder cells 132A within the first air inflatable gripper arm 126A and second arm bladder cells 132B within the second air inflatable gripper arm 126B. As shown by FIGS. 2A and 2B, described in more detail later in this disclosure. Materials and structures of the first arm bladder cells 132A and of the second arm bladder cells 132B and of other regions of the air inflatable soft gripper 124 can be configured to impart a wrapping or pincer form of deployment characteristic to the air.

The FIGS. 1A and 1B implementation of the soft gripper arm connector hub 126 includes an external inflation port 134 that can receive, via tube 136 inflation gas from a gas source 138. The gas source 138 can be, for example, a switchable valve that receives inflation gas from, e.g., an external compressed air tank. Alternatively, or additionally the gas source 138 can include a local storage tank. The valve feature of the gas source 138 can be controlled by a resource, e.g., in the main hub module 102.

In an implementation, an internal power supply 140 and a controller 142 (shown in FIG. 1B) can be included in the main hub housing 108 of the main hub module 102. The internal power supply 140 can be a power resource implemented, for example, by multiple resources, or can be a single apparatus or device. For example, one implementation of the internal power supply 140 can provide a power resource for CPR cyclical pressure applicator module 104, and a power resource for other components, e.g., the controller 142. Particular power parameters for the internal power supply 140 can be based in part on application-specific factors, e.g., desired system weight, and desired number of consecutive uses. For one or more applications, consideration of implementations may, but do not necessarily encompass ranges that can include, for example, for DC storage battery implementations, batteries rated for storing approximately 7.4 volts, with storage a capacity of, for example, approximately 3000 milliamp-hours.

FIG. 2A shows a perspective view of an example of a direct-connect, remote modular CPR system 200A according to another embodiment. In the FIG. 2A embodiment, the direct-connect implementation of the remote nodular CPR system 200A includes a main hub implemented CPR repeating cycle pressure applicator module 202, communicatively connected to and supportively attached to an attachment hub implemented direct-connect gas inflation actuated soft gripper module 204. The main hub implemented CPR repeating cycle pressure applicator module 202 can be implemented, for example, by a CPR repeating cycle pressure applicator 206 mounted on, or otherwise adapted to a main hub housing 208. The main hub housing 208 can be implemented, for example, by the main hub housing 108 of system 100 of FIGS. 1A and 1B, or by a generic main hub housing, as described in more detail in later sections of his disclosure. The attachment hub implemented direct-connect gas inflation actuated soft gripper module 204 can be implemented, for example, by a gas inflation actuated soft gripper 210 mounted on, or otherwise adapted to an attachment hub housing 212. The attachment hub housing 212 can be implemented, for example, by the second attachment hub housing 112 of system 100 of FIGS. 1A and 1B, or a by generic attachment hub housing, as described in more detail in later sections of his disclosure.

FIG. 2B shows a perspective view of an example of a direct-connect, remote modular CPR system 200B according to another embodiment, including a main hub implemented, gas inflation actuated soft gripper module 214 communicatively connected to and supportively attached to an attachment hub implementation of a CPR cyclical pressure applicator module 216. The main hub implemented, gas inflation actuated soft gripper module 214 can be implemented, for example, by a gas inflation actuated soft gripper 218 mounted on, or otherwise adapted to a main hub housing 220. The main hub housing 220 can be implemented, for example, by an adaptation of the main hub housing 108 of system 100 of FIGS. 1A and 1B, or by a generic main hub housing, as described in more detail in later sections of his disclosure. The attachment hub implemented CPR repeating cycle pressure applicator module 216 can be implemented, for example, by CPR pressure applicator 222 mounted on, or otherwise adapted to an attachment hub housing 224. The attachment hub housing 224 can be implemented, for example, by the second attachment hub housing 112 of system 100 of FIGS. 1A and 1B, or a by generic attachment hub housing, as described in more detail in later sections of his disclosure.

In another embodiment, a direct-connect, remote modular CPR system can be implemented by certain adaptations of the system 100 CPR cyclical pressure applicator module 104, or the system 100 gas inflation actuated soft gripper module 106, or both. An example adaptation can include replacing, in the CPR cyclical pressure applicator module 104, one or more of the engagement-attachment connectors with structure of the main hub attachment structure, while maintaining the gas inflation actuated soft gripper module 106. The replacement structure can include protruding magnets 116 or other structure as described above, e.g., but not limited to, magnets disposed in protruding non-magnetic material. An example adaptation can also include modifying one among or both the CPR cyclical pressure applicator module 104 and the gas inflation actuated soft gripper module 106, to carry resources for remote modular CPR system 200A support functions, described as carried for the system 100 by the main hub module 102, i.e., batteries, power supply, processing resources, and various controller functionalities.

In an embodiment, the structure formed by the removable attachment of the attachment hub housing 224 to the main hub housing 220 can be referenced as a frame. An example remote modular CPR system can be formed on the described frame by mounting to the frame an inflation actuated soft gripper device, such as operative structures of the CPR cyclical pressure applicator module 104, and a soft gripper device, such as operative structure of the gas inflation actuated soft gripper module 106, that is configured to receive an inflation gas at an operative pressure and, in response, change form to a deployed grip state that accommodates and grips a human torso. The CPR pressure applicator device of the above-described example remote modular CPR system, e.g., the CPR cyclical pressure applicator module 104 can, as described above in reference to FIGS. 1A and 1B, be configured to receive an actuator power and a CPR control signal and, in response, concurrent with the deployed grip state of as gas inflation actuated soft gripper module 106, can cyclically extend and retract a pressure applicator, e.g., the FIGS. 1A and 1B CPR pressure applicator element 122, along an axis, e.g., the CLP axis. In an embodiment, the described example remote modular CPR system can be configured such that the CPR pressure applicator device is supported by the frame (e.g., the assembly of the attachment hub housing 224 to the main hub housing 220) a configuration enabling alignment of the axis of the CPR movement with a sternum of the human torso.

Systems embodying described features of the direct-connect, remote modular may have some differences, e.g., in mission flexibility and in some operational metrics, (e.g., possibly due to some reduction of battery volume) in comparisons with implementations of the system 100. However, there may be some features for some applications, such as a reduction in the population of modules.

In an embodiment, one or more power sources, e.g., batteries, one or more power supplies, e.g., voltage converters and regulators, controller resources, e.g., computer devices with digital and user interface resources can be included in, a controller resource which can be included in, or mounted to implementations of the example remote modular CPR system.

Figure 3:
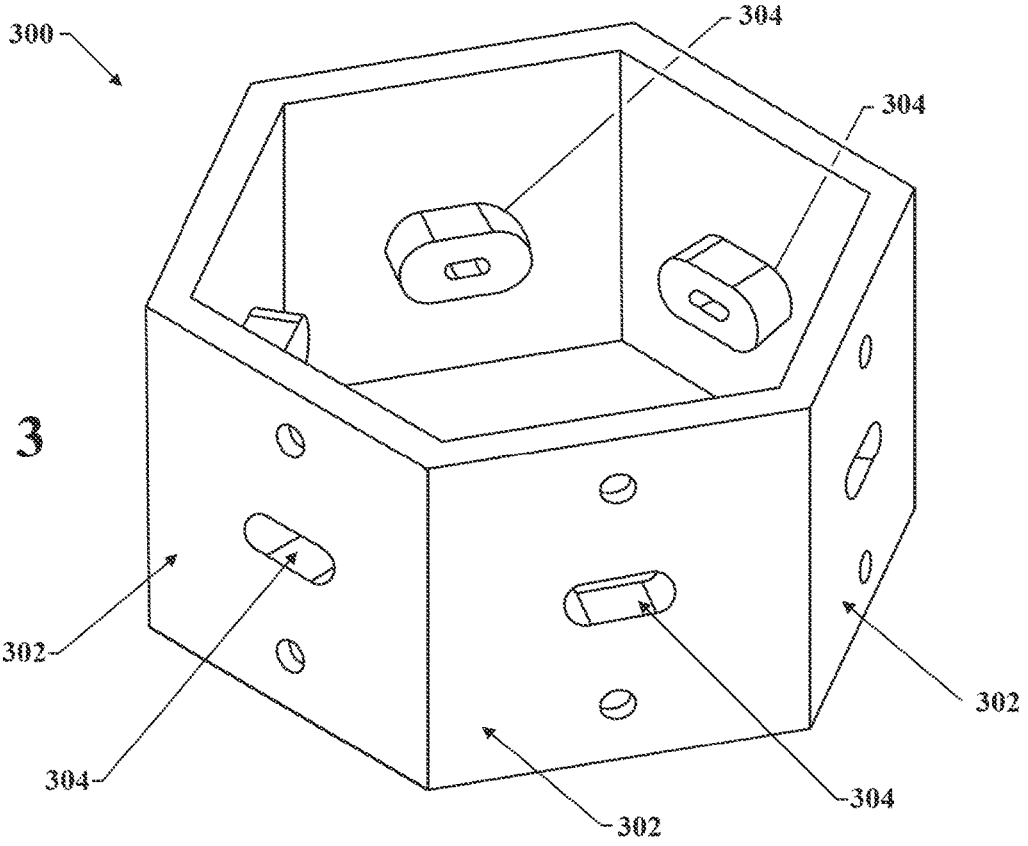
FIG. 3 shows a perspective view of an example generic main hub, featuring a hexagonal main hub housing, for modular remote CPR systems according to various embodiments.

FIG. 3 shows a perspective view of a configuration, according to an embodiment, of a generic hexagonal main hub housing 300, for modular remote CPR systems according to one or more embodiments. The generic hexagonal main hub housing 300 can include, for example, in one or more of, or in each of the housing sidewalls 302 main hub communication cable connector 304. The main hub communication cable connector 304 can be implemented, for example, by a standard protocol communication cable connector, for example, and without limitation, a female USB-C connector.

Figure 4:
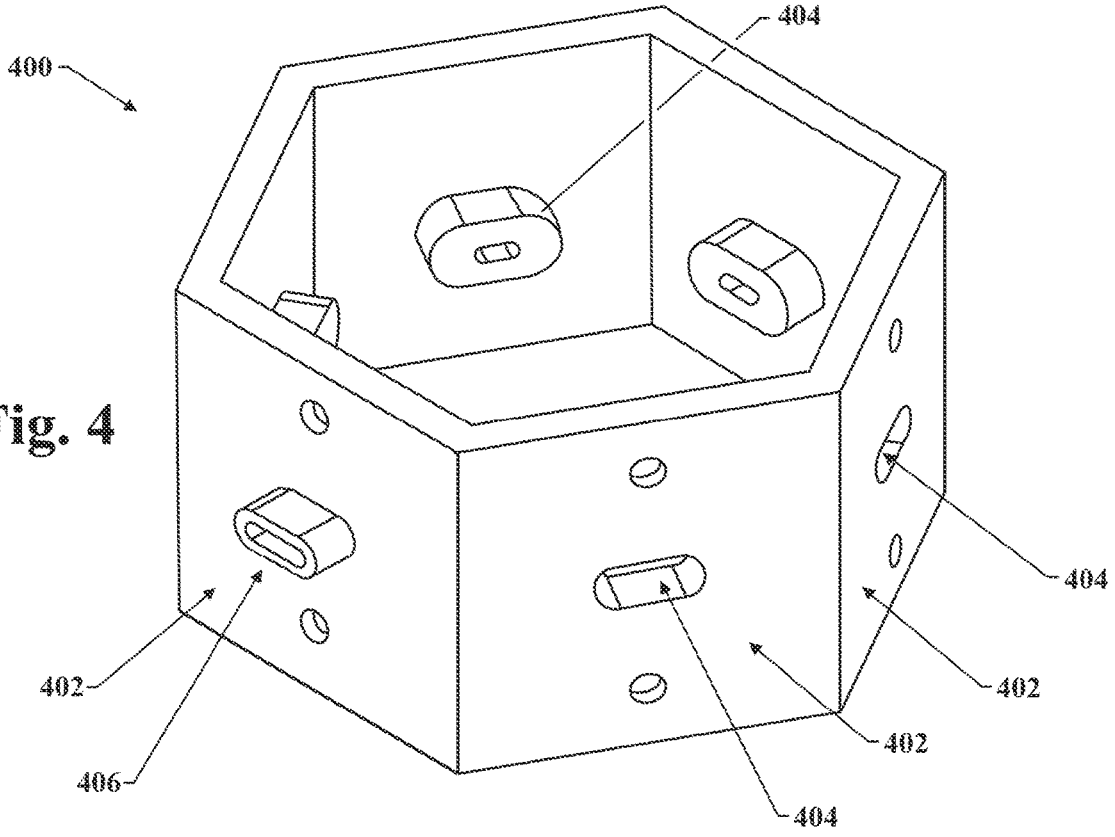
FIG. 4 shows a perspective view of an example generic attachment hub, featuring a hexagonal housing, for modular remote CPR systems according to various embodiments.

FIG. 4 is a perspective view of one generic implementation of a generic hexagonal attachment hub 400, for one or more embodiments of a modular remote CPR system in accordance with the present disclosure. The generic hexagonal attachment hub 400 can include, on each of five of its six faces 402, an attachment hub communication cable connector 404, e.g., but not limited to, a female USB-C connector. One of the generic hexagonal attachment hub 400 faces is shown as an attachment hub cable connector 406. In an embodiment, the attachment hub cable connector 406 can be configured to connect to any of the main hub communication cable connectors 304. For example, if the main hub communication cable connectors 304 are female USB-C connectors, the attachment hub cable connector 406 can be a male USB-C connector.

Figure 5:
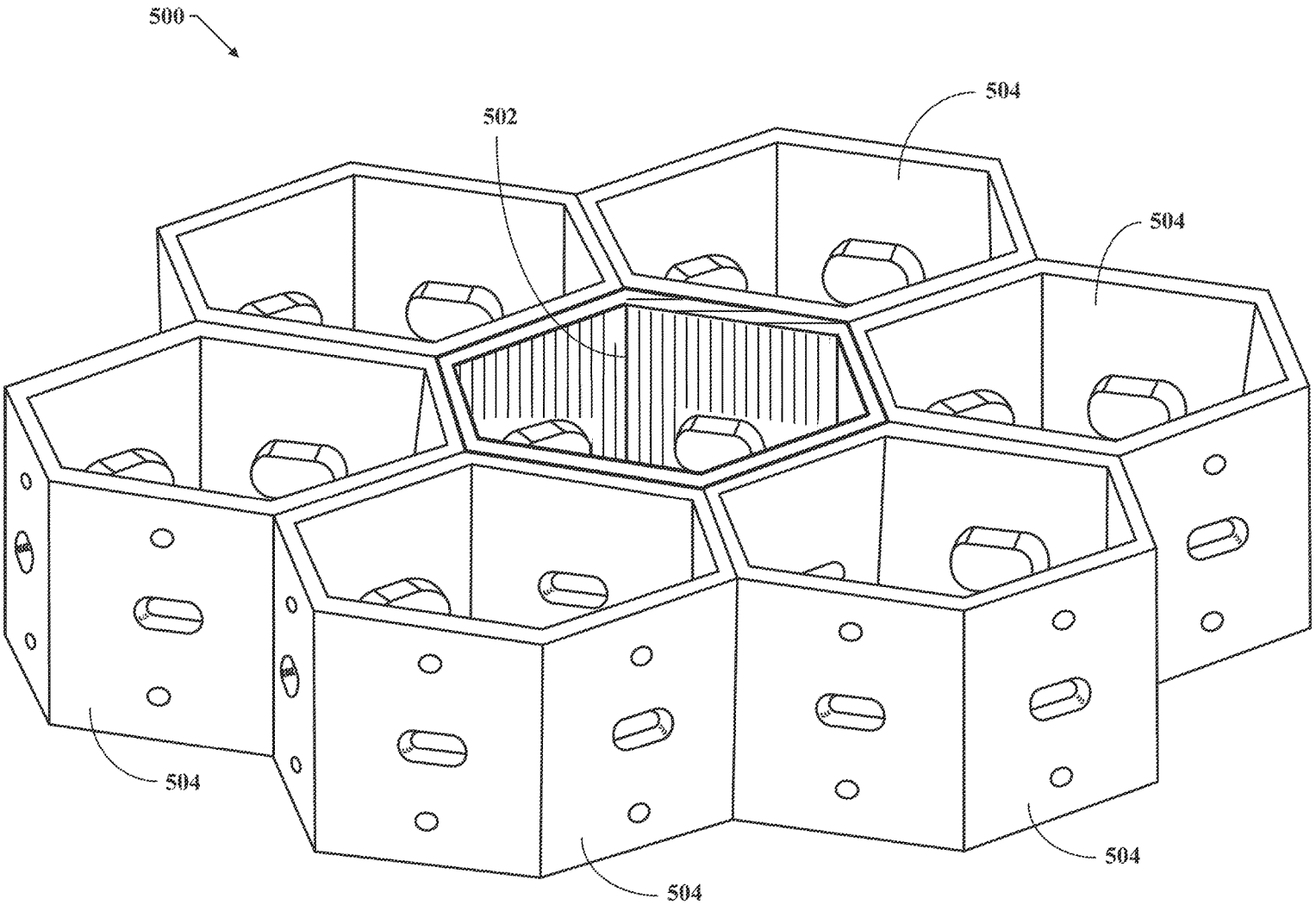
FIG. 5 shows a perspective view of an example assembled configuration of reconfigurable modular assembly in accordance with one or more embodiments, including the FIG. 3 example hexagonal generic main hub in a mutual attachment configuration with an illustrative set of FIG. 4 hexagonal generic attachment hubs.

FIG. 5 shows a perspective view of an example assembled, readily disassembled modular assembly 500 in accordance with one or more embodiments. The modular assembly 500, as shown, includes an example hexagonal generic main hub 502 according to an embodiment, in a secure and removable mutual attached combination with an illustrative set of hexagonal generic attachment hubs 504 in accordance with one or more embodiments.

In an embodiment, an air inflation soft gripper module can implement the first inflatable gripper arm and second inflatable gripper arm to include respective air bladder cells that can be supported, for the first inflatable gripper arm, by a first arm underside base and, by the second inflatable gripper, by a second arm underside base. The first air inflatable gripper arm can include first arm elastic structure forming a plurality of first arm bladder cells, attached to the first arm underside base, which enclose respective portions of the first arm internal volume. In an embodiment, the first arm bladder cells can be distributed to provide, when not inflated, a first arm interspacing between respective exterior surfaces of adjacent first arm bladder cells. The embodiments can include further configuration of the distribution of the first arm air bladder cells to effectuate, when inflated to the operative pressure, particular contacts between the respective exterior surfaces of adjacent first arm bladder cells. In accordance with one or more embodiments, the distribution, as well as the respective shape(s), thicknesses, and dimensions of the first arm air bladder cells can be configured to provide particular contact that exert particular first arm lateral forces. Such configuration can be selected such that the lateral forces have configurations, e.g., magnitudes, directions, and distributions that collectively force particular time evolution and end state as to dimension, shape, and orientation. The time evolution and end state can be configured to provide desired, safe, effective gripping of a human.

In embodiments, the second arm inflatable gripper arm can be similarly configured, for similar operation and purposes. Such embodiments can include, for example, elastic structure enclosing the second arm internal volume by a plurality of second arm bladder cells, connected to the second arm underside base. The second arm bladder cells can be shaped, dimensioned, and distributed to provide, when not inflated, a second arm interspacing between respective exterior surfaces of adjacent second arm bladder cells and, when inflated, to attain second arm contacts between the respective exterior surfaces of adjacent second arm bladder cells. The second arm contacts can exert respective second arm lateral forces that sum to a second arm net force, which effectuates, at the operative pressure, expansion of the second inflatable gripper arm to the deployed state.

FIG. 6A shows a partial cutaway front projection view of a non-inflated state of an example of such embodiment of a gas inflation deployable soft gripper device 600, for remote modular CPR systems in accordance with one or more embodiments, FIG. 6B is a cross-cut projection view of certain structure of the FIG. 6A gas inflation deployable soft gripper device 600, as visible on FIG. 6A cross-cut projection plane 6B-6B. FIG. 6C is a projection view, on the same projection as FIG. 6A, showing an inflated, fully deployed state of the FIG. 6A implementation. In overview, the gas inflation deployable soft gripper device 600 can provide the above-described dimensions, shapes, and distribution of air bladders using a particular configuration and distribution of hollow fins supported by a particularly configured extended arm base.

Referring to FIG. 6A, the gas inflation deployable soft gripper device 600 can include a soft gripper arm connector hub 602, a first gas-inflatable gripper arm 604A, and a second gas-inflatable gripper arm 604B. An inflation tube 605 can connect to an external inflation port in an upper region of arm connector hub 602. In an embodiment, a portion, e.g., an upper portion of the soft gripper arm connector hub 602, can be configured to attach, for example, to the second attachment hub housing 112 of the FIG. 1 system 100 air inflatable soft gripper module 106 or, referring to FIG. 2B, to the main hub housing 220 of the main hub configured air inflation soft gripper module 214.

Referring to FIG. 6A, according to various embodiments the first gas-inflatable gripper arm 604A can enclose a first arm internal volume, for filling with inflation gas at deployment. In the example shown in FIGS. 6A and 6B, a portion of the first arm internal volume will be referred to as the "first arm gas distribution volume" and is shown enclosed by a first arm gas distribution base 606A. The first arm gas distribution base 606A is visible in cross-section, viewed on the FIG. 2B cross-section plane 6A-6A, and can extend outward a first arm length L1 from the first arm base end. Referring to FIG. 6B, the first arm gas distribution base 606A can extend a width LW1, in a direction that extends normal to and co-planar with the length L1 direction. In an embodiment, the second gas-inflatable gripper arm 604B can be configured similarly to or identical to the first inflatable gripper arm 604A. As shown, the second arm gas distribution base 606B can extend outward, e.g., the same amount as the first arm length L1, from the second arm base end and can enclose a similarly configured second arm gas distribution volume.

In an embodiment, the first gas-inflatable gripper arm 604A can include, as first arm bladder cells, a plurality of first arm hollow fins 608A. The first arm hollow fins 608A can be formed by respective pairs of elastic material fin walls. The fin wall form outward facing surfaces paced apart by fin thickness W1, extend up from the first arm gas distribution base 606A, and have end walls that, in combination, enclose respective compartments of the first arm internal volume. The second gas-inflatable gripper arm 604B can include, as second arm bladder cells, a plurality of second arm hollow fins 608B, formed by respective pairs of elastic material fin walls as described above for the first arm hollow fins 608A, i.e., pairs of elastic material fin walls shaving outward facing walls paced apart by fin thickness W1, extending upward from the second arm gas distribution base 606B, and enclosing respective compartments of the second arm internal volume.

In an embodiment the gas inflation deployable soft gripper device 600 can include a first internal inflation port 610A, from an interior of the soft gripper arm connector hub 602 to an interior of the first gas-inflatable gripper arm 604A, and a second internal inflation port 610B, from an interior of the soft gripper arm connector hub 602 to an interior of the second gas-inflatable gripper arm 604B. Alternative structures for an inflation gas path to the interior of the first gas-inflatable gripper arm 604A can include an external tube, as opposed to the hollow structure of the soft gripper arm connector hub 602 and first internal inflation port 610A. Similar alternative structure can provide an inflation gas path to the interior of the second gas-inflatable gripper arm 604B.

As further visible in the expanded area of FIG. 6A, structure and arrangement of the first arm hollow fins 608A, in addition to first arm fin thickness, W1, can include the first arm hollow fins 608A being spaced, when uninflated, by a distance W2 of spacing 612. The spacing distance W2 means between adjacent hollow fins, e.g., mutually facing surfaces of adjacent ones of the first arm hollow fins 608A. During inflation, a flow of inflation gas, represented by dotted line arrows in FIG. 6A, passes from the first arm gas distribution volume, through base gaps visible in the figure, into the first arm hollow fins 608A. The increasing pressure expands the first arm hollow fins 608A in the width direction. In an embodiment, the first arm hollow fins 608A are dimensioned and structured such that the width W1' at operative pressure has a value effectuating contact, i.e., the expansion forces adjacent ones of the first arm hollow fins 608A into contact. The contacts create a net force that effectuates a curvature in the first gas-inflatable gripper arm 604A', as visible in FIG. 6C. In like manner, as also visible in FIG. 6C, inflation of the second arm hollow fins 608B, by expanding fin widths to W1' created contacts between the second arm hollow fins 608B, which sum to force a curvature in the second gas-inflatable gripper arm 604B'.

Figure 7:
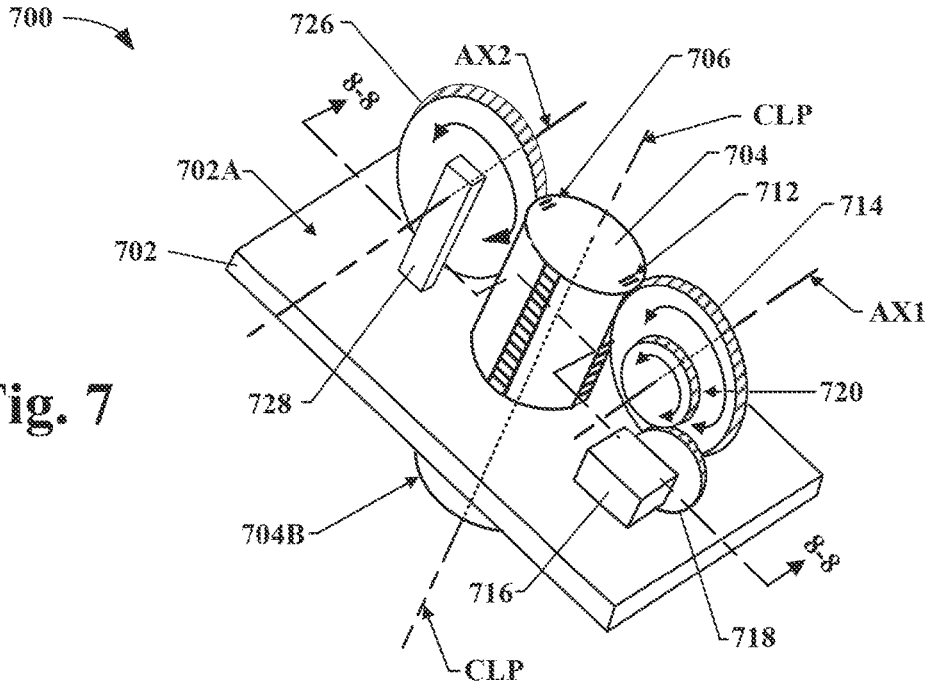
FIG. 7 is a perspective view of structural features of an example CPR pressure applicator for implementations of a CPR pressure applicator module for one or more modular remote CPR systems in accordance with various embodiments.
Figure 8:
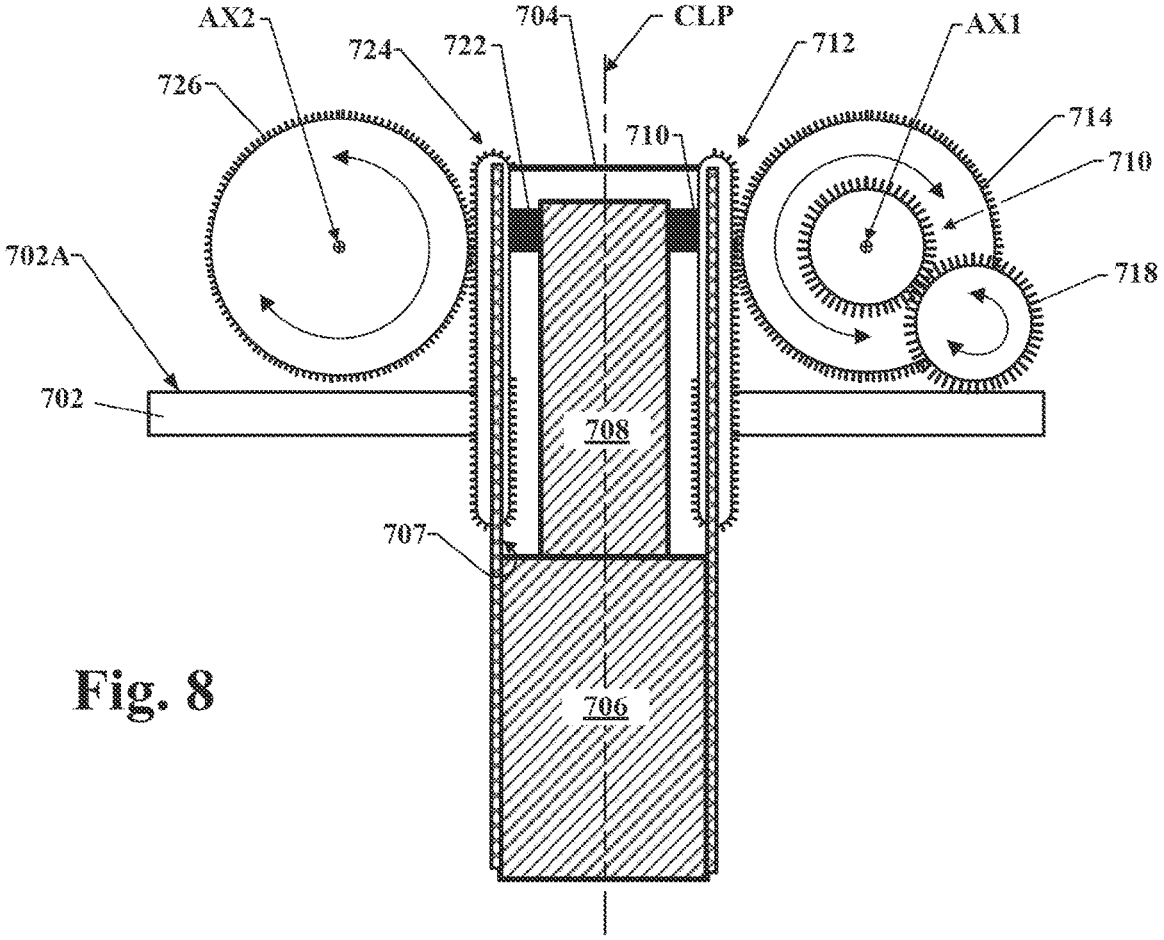
FIG. 8 is a multi-plane cross-cut projection view of structure of the FIG. 7 example CPR pressure applicator, on FIG. 7 projection 8-8-8-8, with overlaid annotations showing item movability.

In an embodiment, a CPR cyclical pressure applicator can be implemented with a support plate, mounted to or formed by a housing, e.g., the generic hexagonal attachment hub 400 described above. Mounted to the support plate can be a movement guide or movement support, for a CPR application structure. An actuator for the CPR application structure can include, for example, a rotary actuator motor that includes a rotatable output shaft. In an embodiment, coupled to the rotatable output shaft can be rotary to linear movement converter that, in response to rotation of the rotatable output shaft, drives a linear actuator member. The CPR application structure can, for example, couple to the linear actuator member. FIGS. 7 and 8 are perspective and projection views, respectively, of an example implementation, FIG. 7 is a perspective view of structural features of an example of a CPR pressure applicator device 700 (hereinafter referred to as CPR pressure applicator 700"). In overview, implementations and adaptations of the CPR pressure applicator device 700 can provide CPR pressure application functionality to different modules for modular remote CPR systems in accordance with various embodiments. For example, referring to FIGS. 1A, 3, and 7, in contemplated embodiments, an example CPR cyclical pressure applicator module 104 can be implemented by adapting or configuring a device according to the CPR pressure applicator device 700 on or within a configuration of the FIG. 3 generic hexagonal attachment hub 400.

Referring to FIG. 7, implementations of the CPR pressure applicator device 700 can include a base member 702 which, as shown in FIG. 7 can include a plate that can provide a base member top surface 702A. It will be understood that the base member 702 represents a functionality, e.g., physical support for an example set of components, including maintaining of certain relative positionings and engagements between such components. The illustrated physical configuration of the base member 702 is an example, it is not intended as a limitation. For example, contemplated embodiments can utilize alternatives to the plate implementation of the base member 702. Such alternatives can include, without limitation, adaptation of structure of the first attachment hub housing 110 of the CPR cyclic pressure applicator module 104, or adaptation of the FIG. 2A main hub housing 208 of the main hub implemented CPR cyclic pressure applicator module 202. Other alternative can include, without limitation. adaptation of the attachment hub 230 of the FIG. 2B attachment hub implemented CPR cyclic pressure applicator module 216. For convenience, detailed description of features, functionalities, and aspects of the FIG. 7 example of the CPR pressure applicator 700 will reference the base member 702 and the base member top surface 702A. It will therefore be understood, by persons of ordinary skill in the art while reading the following description, that such references are for convenience, e.g., a simple physical reference that does not introduce complexities, and that is easily carried over to implementation using a different structure or combination of structures for described functionality of the base member 702.

CPR pressure application device 700 can include a CPR applicator element housing 704, and since FIG. 7 shows only visible external surfaces, description of structure that, for this example, can be disposed within the CPR applicator element housing 704 will include reference to FIG. 8. This figure shows a stepped plane, multi-projection cross-sectional view, on a stepped projection planes defined by FIG. 7 stepped projection 8-8. Referring to FIGS. 7 and 8, in an embodiment, disposed within the CPR applicator element housing 704 can be a CPR applicator element. In an implementation of the embodiment, the CPR applicator element can include a supported portion 706, which can be dimensioned and shaped to cooperate, in a linear movement in directions CLP that are aligned with the CPR exertion axis CX, with an inward facing guide surface 707 of the CPR applicator element housing 704. The inward facing guide surface 707 can likewise be aligned with the CPR exertion axis CX. In an example implementation, the supported portion 706 of the CPR applicator element 704 can be a piston-type structure, e.g., cylindrical and the inward facing guide surface 707 can be a cooperatively dimensioned inward facing cylindrical surface. In an embodiment, the outer surface of the supported portion 706 of the CPR applicator element 704 or the inward facing guide surface 707, or both, can be coated with an anti-friction material.

In an embodiment, the CPR applicator element 704 can be connected, e.g., via a connector portion 708 coupled, via an actuation coupling 710, to a rolling linear movement rack 712. The rolling linear movement rack 712 can be supported, for example, by structure of the CPR applicator element housing 704. A pinion gear 714, arranged to rotate about an axis AX1, can engage the rolling linear movement rack 712. It will be understood that counterclockwise rotation (from a viewing direction facing the sheet carrying FIGS. 7 and 8) of the pinion gear 714 urges a rolling movement of the rolling linear movement rack 712 in a direction that, via the actuation coupling 710, urges the CPR applicator element down. Clockwise rotation of the pinion gear 714 urges an opposite rolling movement of the rolling linear movement rack 712 that, via the actuation coupling 710, urges the CPR applicator element upward.

Actuation of the pinion gear 714 can be provided by a servo motor 716, which can be a rotary motor, configured to selectively actuate, via a rotary output shaft, a rotation of a primary drive gear 718. The servo motor 716 elective actuation can include rotating direction, rate of rotation, and rotation force. The latter two can have an interrelation. Clockwise rotation of the primary drive gear 718 can urge a counterclockwise rotation of an intermediate drive gear 720, In the FIGS. 7 and 8 example, intermediate drive gear 720 is coaxial with the pinion gear 714. Accordingly, clockwise rotation of the servo motor 716 urges the CPR applicator element downward, while motor 716 counterclockwise rotation urges the CPR applicator element upward. It will be understood that the primary drive gear 718, intermediate drive gear 720, pinion gear 714, and rolling linear movement rack 712, are an example implementation of a rotary-to-linear drive translator. Structure of the primary drive gear 718 receiving the output shaft of the servo motor 716 can function as a rotary drive input, and the rolling linear movement rack 712 can function as a linear drive output. The example rotary-to-linear drive translator, via reversibility of the servo motor 716, function as a reversible linear movement actuator. The FIG. 7 example of a rotary-to-linear drive translator is not intended as a limitation. Alternative rotary-to-linear translators can be employed. One example is a crankshaft, rotated by a rotary motor, with a pressure applicator connector coupled, vias or as a connecting rod to a throw of the crankshaft.

In an embodiment, to provide, for example and without limitation, a ready reserve of higher CPR exertion force, and/or to reduce actuator motor load, and for other benefits, the CPR pressure application device 700 can include multiple rolling linear movement racks. For example, as illustrated, the rolling linear movement rack 712 can be a first rolling linear movement rack 712, the pinion gear 714 can be a first pinion gear 714, the servo motor 716 can be a first servo motor 716, the primary drive gear 718 can be a first primary drive gear 718, and the intermediate drive gear 720 can be a first intermediate drive gear 720. Continuing, the actuation coupling 710 can be a first actuation coupling 710. Further to such embodiments, the CPR pressure application device 700 can include, e.g., can provide, can be formed on, integral to, or securely attached to the connector portion 708, a second actuation coupling 722 that can couple the connector portion 708 to a second rolling linear movement rack 724. A second pinion gear 726, rotatable about a second axis AX2, can engage the second rolling linear movement rack 724. The second pinion gear 726 can be supported by a support 728. The second pinion gear 726 can be driven, e.g., by a second primary drive gear (similar to 718) driven by a second servo motor (similar to 716), and the second primary drive gear can drive the second pinion gear 726 through, for example, a second intermediate drive gear (similar to 720).

The first servo motor 716 and second servo motor can be implemented by various commercial off-the-shelf servo motors and can be configured actuate forwards and backwards, i.e., apply cyclic forward-reverse drive force, to reciprocate the CPR applicator element to move over a travel distance, e.g., 2-inch travel distance.

The rotation of first servo motor 716 and second servo motor, and the torque requirements of such servo motors, depend on the gear ratios of the gear couplings. For illustration, and without limitation, an implementation can use respective 39 tooth gears for the primary drive gear 718 and for the intermediate drive gear 720 and, for the first pinion gear 714 and the second pinion gear 726 a 77-tooth gear. In this specific implementation, the first servo motor 716 and second servo motor can operate with approximately 45-degree rotation, and with a torque rating of approximately 21 kilogram/centimeters, which can provide sufficient CPR force.

Figure 9A:
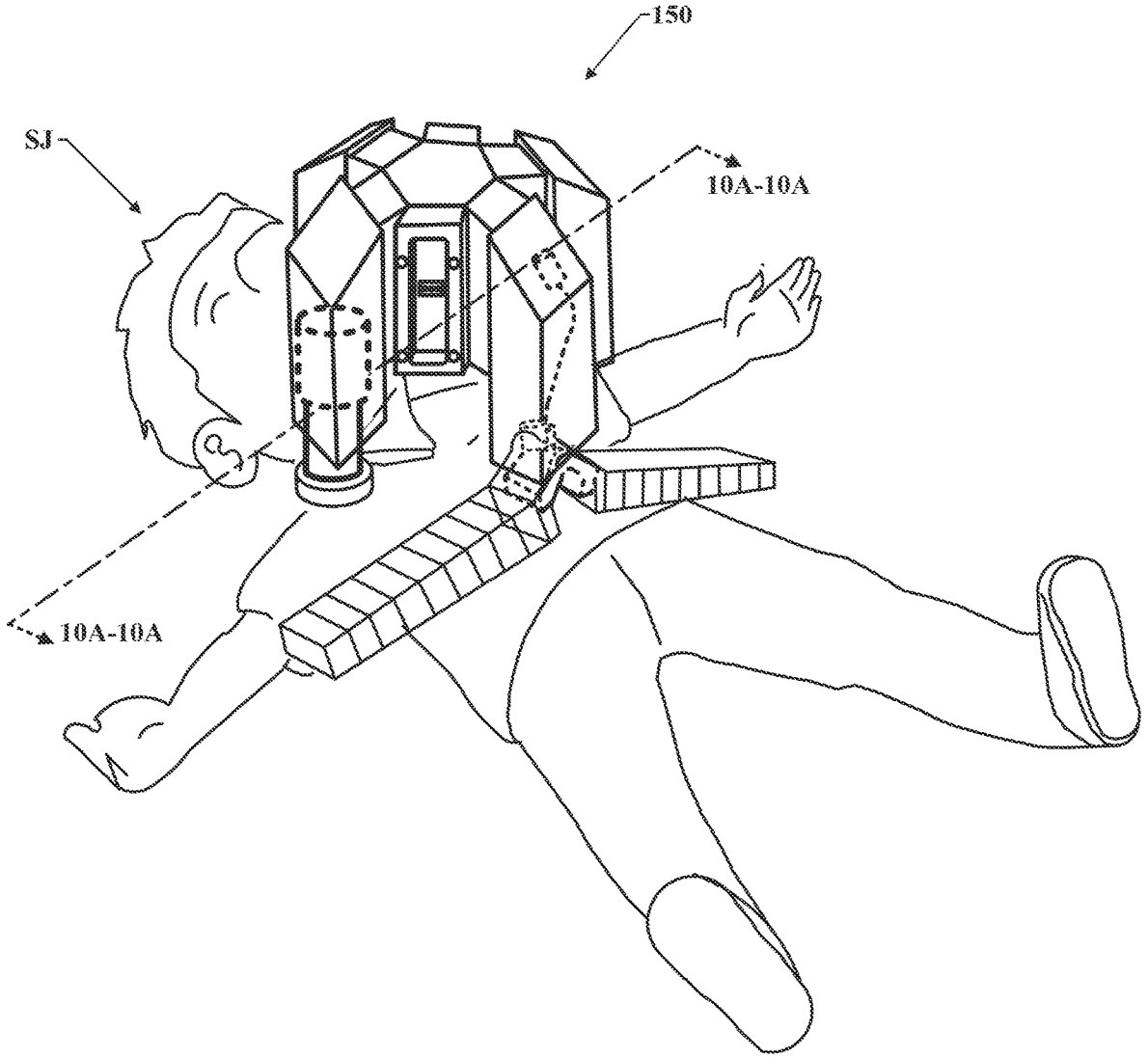
FIG. 9A is a perspective view of an example positioning and arrangement, on a hypothetical prone human, e.g., a patient, of a modular remote CPR system in accordance with various embodiments, showing, for purposes of example, the FIG. 1B system with a not-yet-deployed soft gripper device.
Figure 9B:
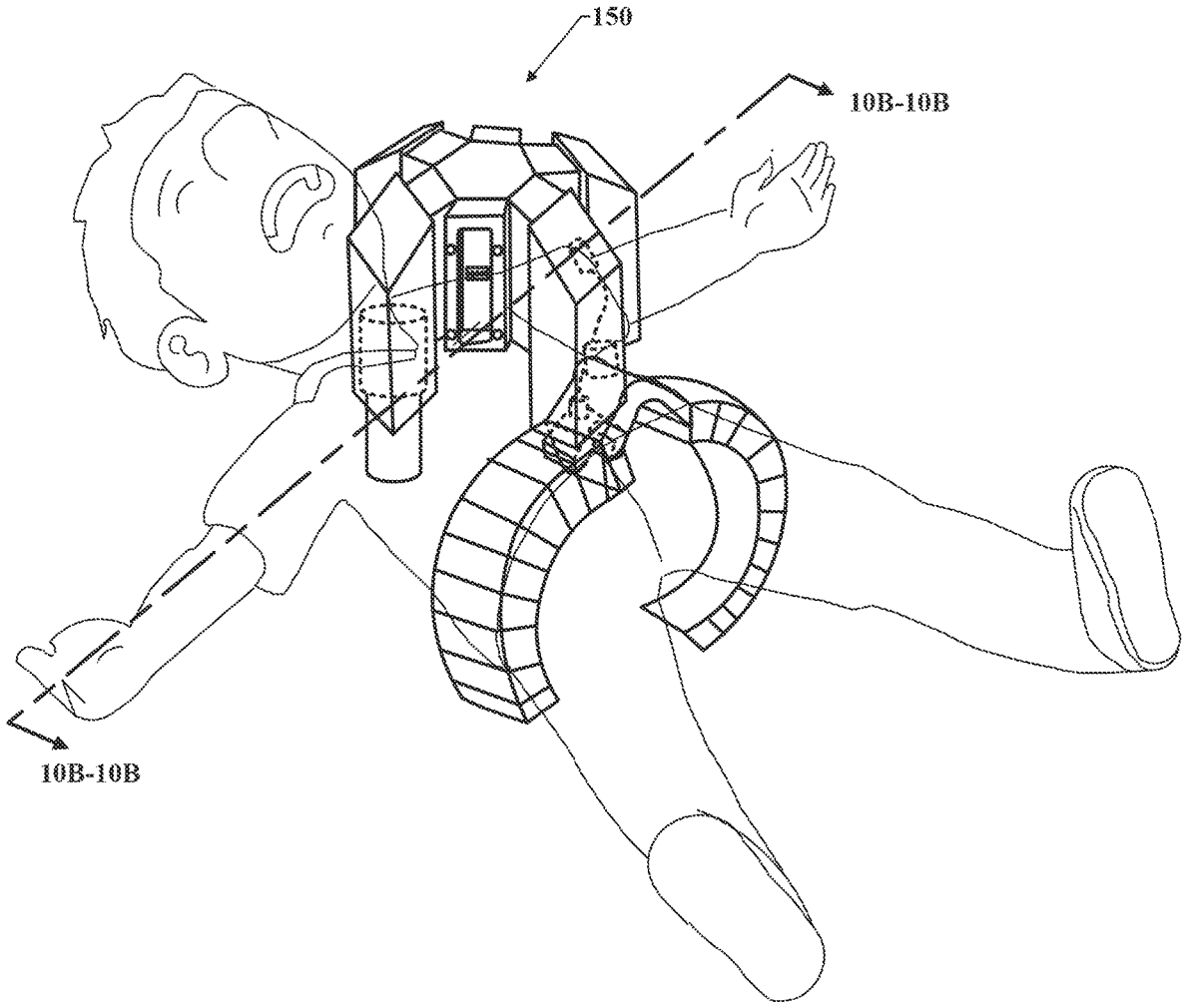
FIG. 9B shows, from the same perspective used for the FIG. 9A view, the example modular remote CPR system after inflation deployment of the soft gripper device, to a full deployment state gripping the patient.

FIG. 9A is a perspective view of an example positioning and arrangement, on a hypothetical prone patient "SJ," of the FIG. 2B remote modular CPR system 200B in accordance with various embodiments. FIG. 9A shows, for purposes of example, the FIG. 2B system with a not-yet-deployed state of a gas inflation actuated soft gripper device 218 (see assembled system 150 in FIG. 1B). FIG. 9B shows, from the same perspective used for the FIG. 9A view, the FIG. 2B remote modular CPR system 200B after inflation deployment of the gas inflation actuated soft gripper device 218, to a full deployment state, gripping the gripping the patient SJ.

Figure 10A:
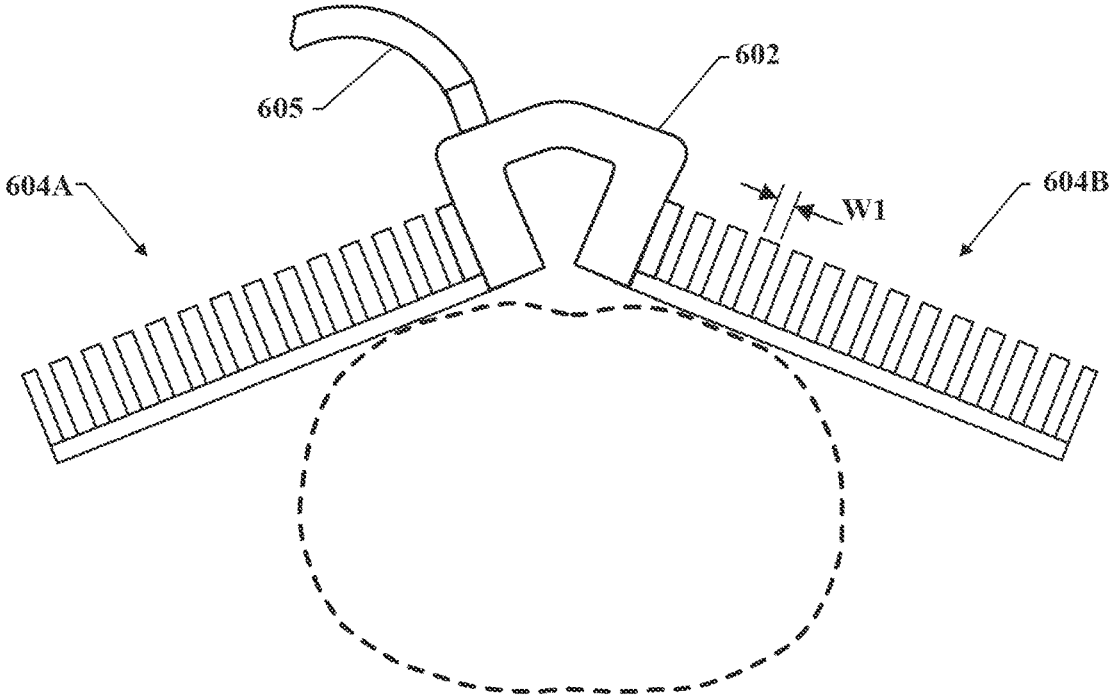
FIGS. 10A and 10B are projection views of example details of inflation deployment of a soft gripper device according to various embodiments, using the FIG. 6A example gas inflation deployable soft gripper device, in the context of the hypothetical shown on FIGS. 9A and 9B, where
Figure 10B:
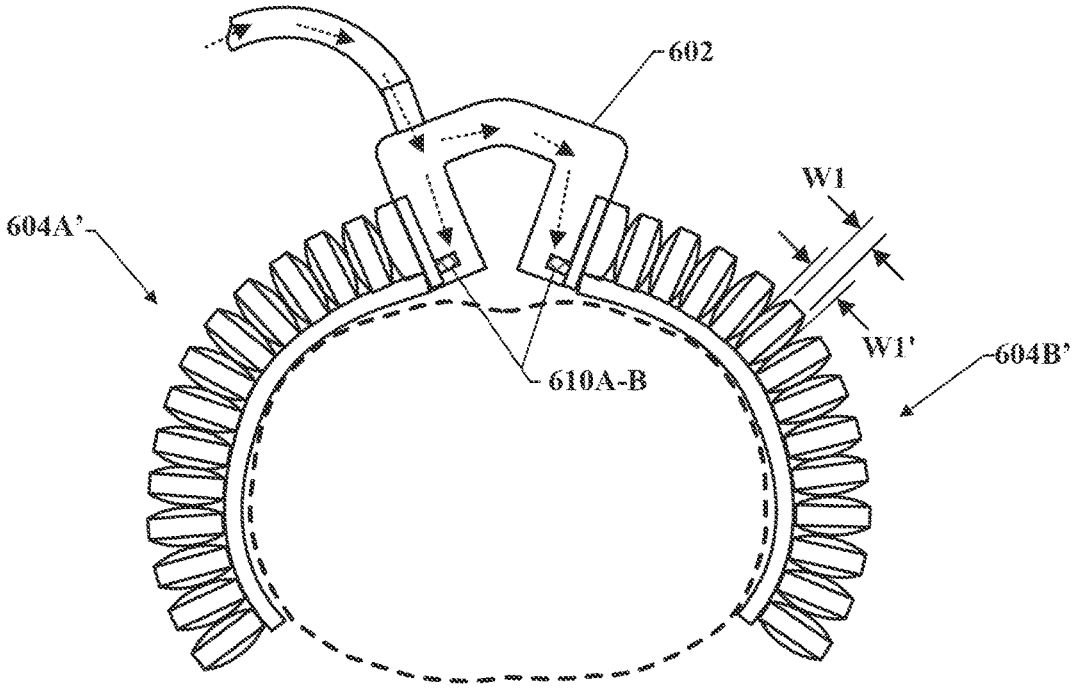

FIGS. 10A and 10B are projection views of example details of inflation deployment of a soft gripper device according to various embodiments, using the FIG. 6A example gas inflation deployable soft gripper device, in the context of the hypothetical shown on FIGS. 9A and 9B, where FIG. 10A shows a cross-sectional view, on FIG. 9A projection 10A-10A, and FIG. 10B shows a cross-sectional view, on FIG. 9B projection 10B-10B.

Figure 11A:
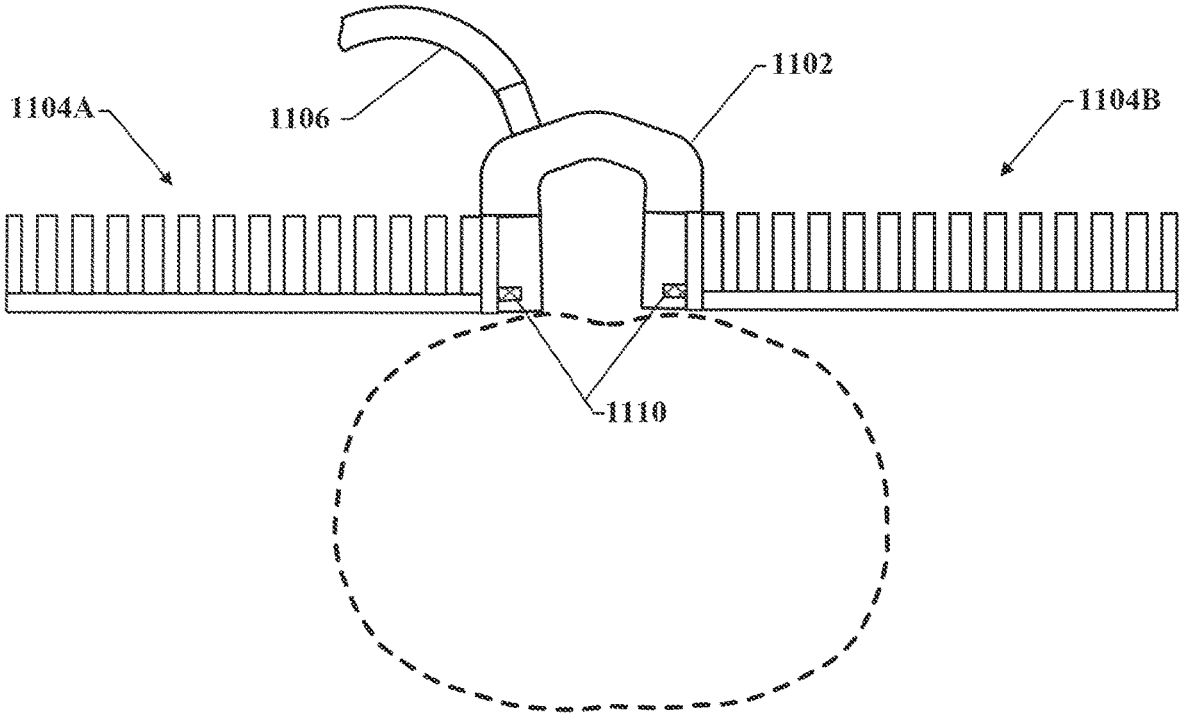
FIGS. 11A and 11B show front projection views of an inflation deployment of another soft gripper device, illustrating an example alternative arm connector hub structure.
Figure 11B:
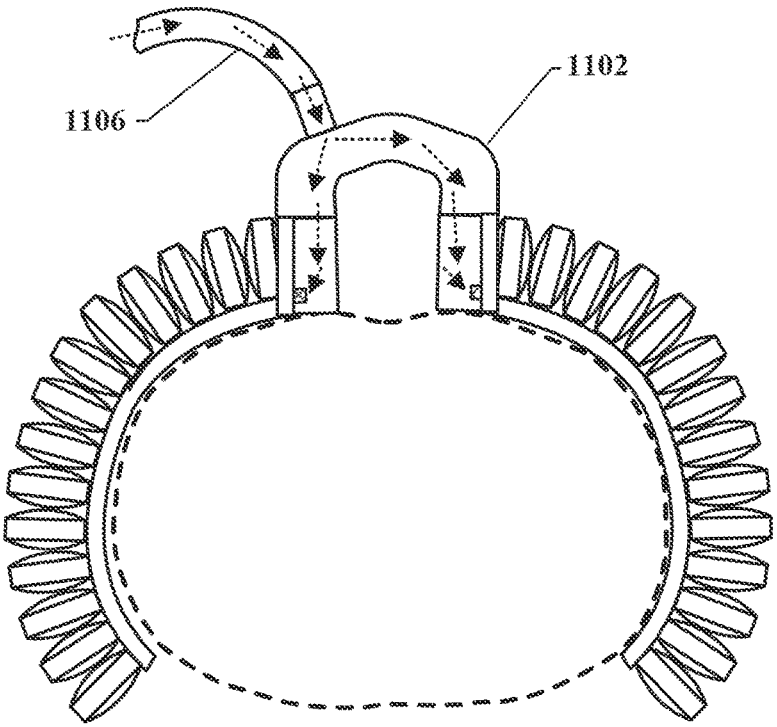

FIGS. 11A and 11B show front projection views of an inflation deployment of another soft gripper device, illustrating an example alternative soft gripper arm connector hub structure. The example is shown at a deployment position above a human torso. The illustrated soft gripper device includes an arm connector hub 1102 structure, having a modified or alternative form with respect to attachment angle of the attached air inflatable arms. The arm connector hub 1102 encloses a plenum chamber, and includes a first arm attachment portion to which a base end of a first inflatable gripper arm 1104A is attached, and a second arm attachment portion to which a base end of a second inflatable gripper arm 1104B is attached (the inflatable arms are collective referenced as "gas inflatable arms 1104."). An inflation tube 1106 can connect to an external inflation port in an upper region of arm connector hub 1102, which is fluidly connected to the interior plenum chamber. An internal inflation port 1110 can fluidly connect the plenum chamber to an interior volume of the first inflatable gripper arm 1104A, and another internal inflation port 1110 can fluidly connect the plenum chamber to an interior volume of the second inflatable gripper arm 1104B. FIG. 11B shows by arrows an incoming inflation gas entering through the inflation tube 1106 into the plenum chamber, and passing through the internal inflation ports 1110 into the respective interior volumes of the inflatable arms 1104. The hollow fins of the inflatable arms 1104, in response, expand in width such that faces of adjacent hollow fins contact one another, exerting lateral forces that urge the respective curvatures. The curvatures are cooperative, so as to accommodate and, e.g., by wrapping partially around the human torso, grip the human torso.

FIGS. 12A through 12F represent snapshots on the FIG. 9A projection 10A-10A, of a modular remote CPR system in accordance with various embodiments, implemented with the FIG. 6A and FIG. 6B gas inflation deployable soft gripper device 600, and the FIG. 7 and FIG. 8 CPR pressure applicator 700 in performing a CPR compression cycle, on a hypothetical patient. Description will reference the modular remote CPR system as the "modular remote CPR system." Visible structure of the CPR pressure applicator 700 includes the first pinion gear 714 and the second pinion gear 726, first actuation coupling 710, second actuation coupling 722, the supported portion 706 and the extension/connector portion 708 of the CPR applicator element. For brevity, description will alternatively reference the CPR pressure applicator element as CPR pressure applicator element 706/708.

As described above, respective rotations of the first pinion gear 714 and the second pinion gear 726 that effect movement of the CPR pressure applicator element 706/708 are necessarily opposite to one another. For purposes of description, servo motor actuation in the CPR pressure applicator 700 that rotating the first pinion gear 714 and second pinion gear 726 in respective directions effectuating downward, i.e., compressive direction movement of the CPR pressure applicator element 706/708, will be referenced as "servo compression actuation." Servo operation effectuating upward, or release direction movement will be referred to as "servo release actuation."

Figure 12A:
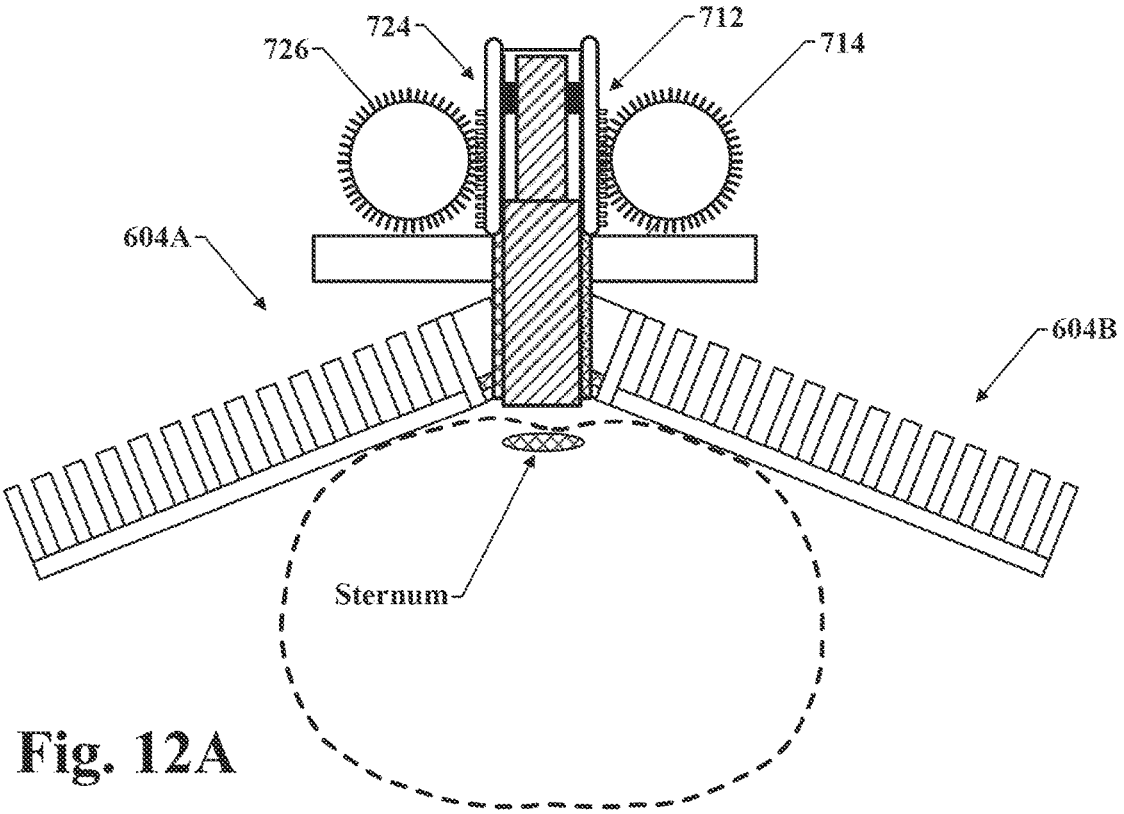
FIGS. 12A through 12F represent snapshots on the FIG. 9A projection 10A-10A, of a modular remote CPR system in accordance with various embodiments, implemented with the FIG. 6A and FIG. 6B air inflatable gripper, and the FIG. 7 and FIG. 8 CPR pressure applicator in performing a CPR compression cycle, on a hypothetical patient.
Figure 12B:
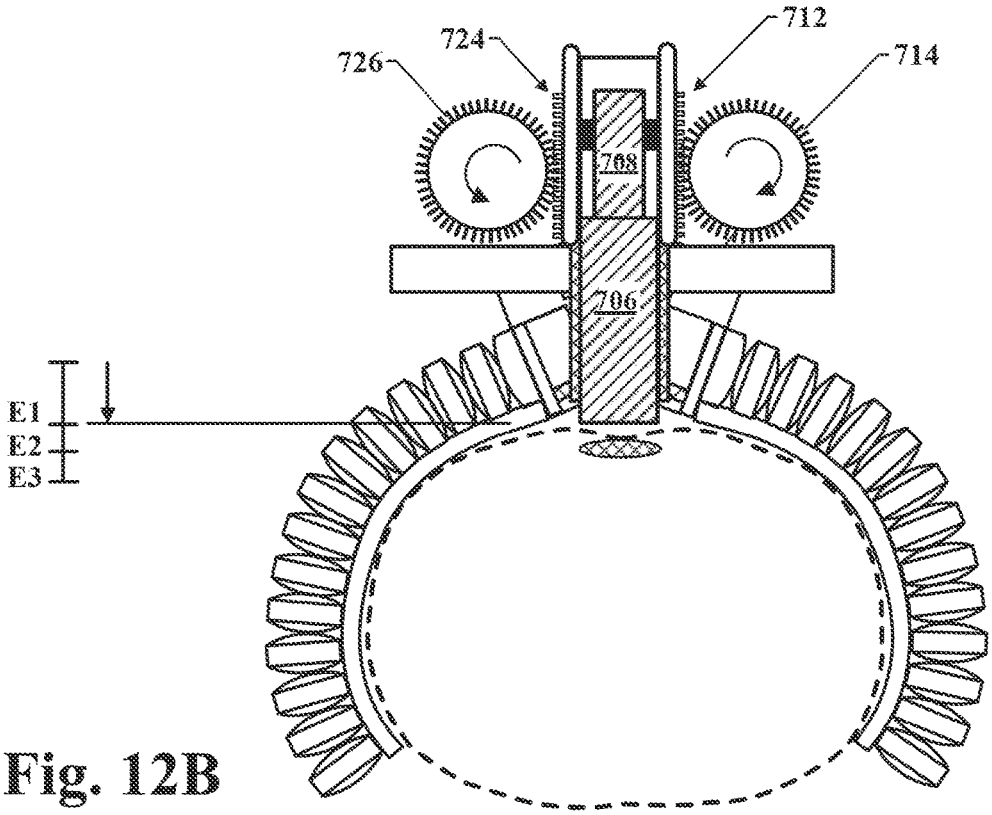

Referring to FIG. 12A, an instance of can begin by placing the described modular remote CPR system on the patient, in a manner aligning the distal end of the CPR pressure applicator element 706/708 with the sternum of the patient. A next operation can include air inflation of the gas inflation deployable soft gripper device 600, to the FIG. 12B visible state, which is the FIG. 6B deployed state in which the first gas-inflatable gripper arm 604A curves and extends to a first pincer configuration 604A' and the second inflatable gripper arm 604B curves and extends to a second pincer configuration 604B'. This forms a pincer that partially wraps and grips the patient. Operation can also include adjustment, e.g., by manual adjustment or by computer resource control, the distal end of the CPR pressure applicator element 706/708 to its initial position "E1", e.g., in contact with the patient's chest above the patient's sternum.

Figure 12C:
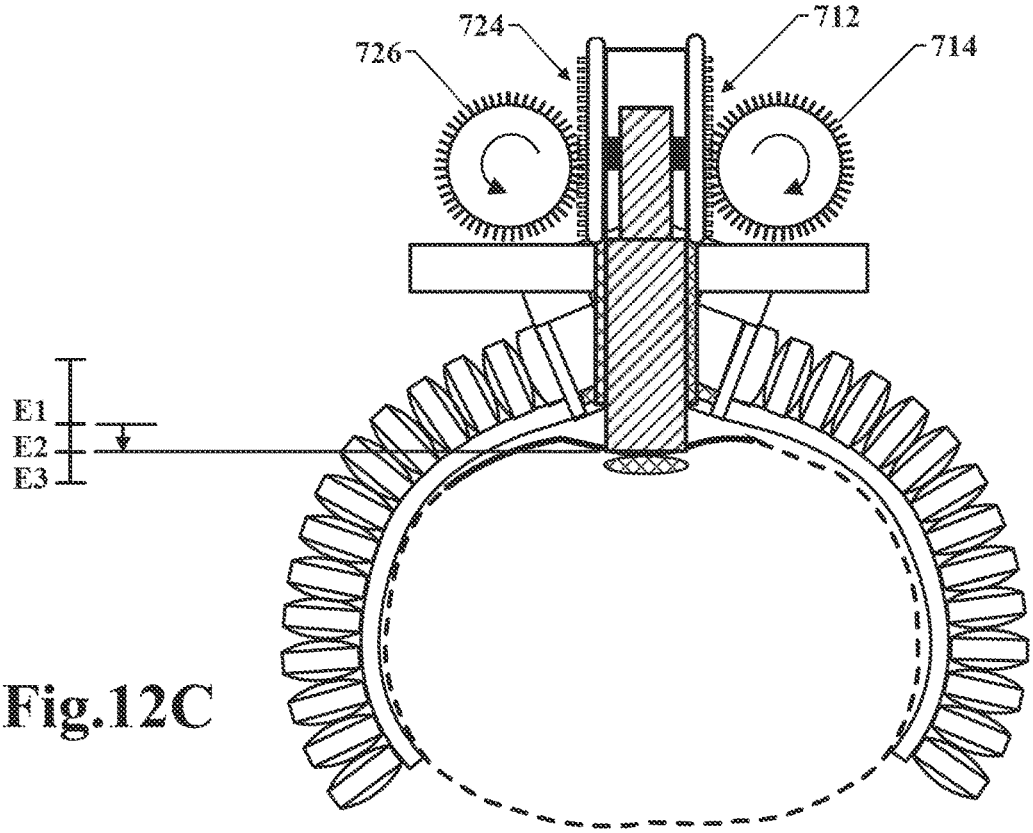

Following initializing the distal end of the CPR pressure applicator element 706/708 to its initial position E1, the servo motors of the CPR pressure applicator 700 can be cyclically energized to perform a sequence of CPR compress-release cycles. Initiation can be, for example, by a first responder pressing a "Start" button on the modular remote CPR system. Alternatively, a remote operator or monitoring personnel can initiate the application of CPR cycles. Upon initiation, compressive actuation, the servo motors of the CPR pressure applicator 700 can continue rotating the first pinion gear 714 and second pinion gear 726 in the FIG. 12B indicated directions, which urges the distal end of applicator element 706/708 downward. FIG. 12C shows a snapshot during downward actuating rotation of first pinion gear 714 and second pinion gear 726 rotation of to "E2", which can be, for example, approximately 1 inch of distance downward. This, in turn, compresses the heart. In an embodiment, pressure exerted by the distal end of the applicator element 706/708 can be approximately 100 lbs. The force, though, will exert a 100 lb. reactionary force upward against the described modular remote CPR system. Depending on various factors, e.g., the particular implementation of the gas inflation deployable soft gripper device 600, and the physique of the patient, the described reactionary force can separate the described modular remote CPR system a distance up upward, away from the patient. Due to such separation, achieving a 1-inch depression at E2 can require extending the distal end of the applicator element 706/708 downward more than 1 inch, with a force that can be, for example, approximately 100 pounds.

Figure 12D:
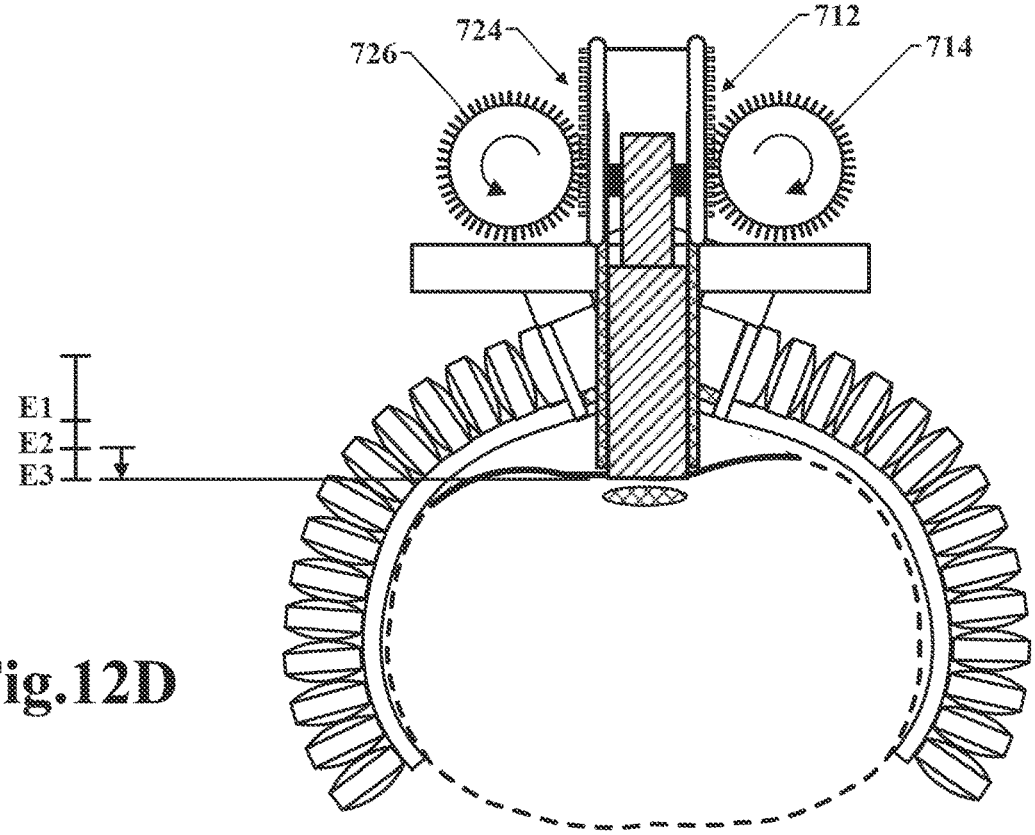

FIG. 12D shows another snapshot after continuing downward actuating rotation of first pinion gear 714 and second pinion gear 726, which lowered the distal end of the applicator element 706/708 downward another increment, for example, approximately another one inch, to what will be assumed a maximum compression depth "E3." This heat is at maximum CP compression, e.g., the applicator element 706/708 still applying what can be approximately 100 lbs.

Figure 12E:
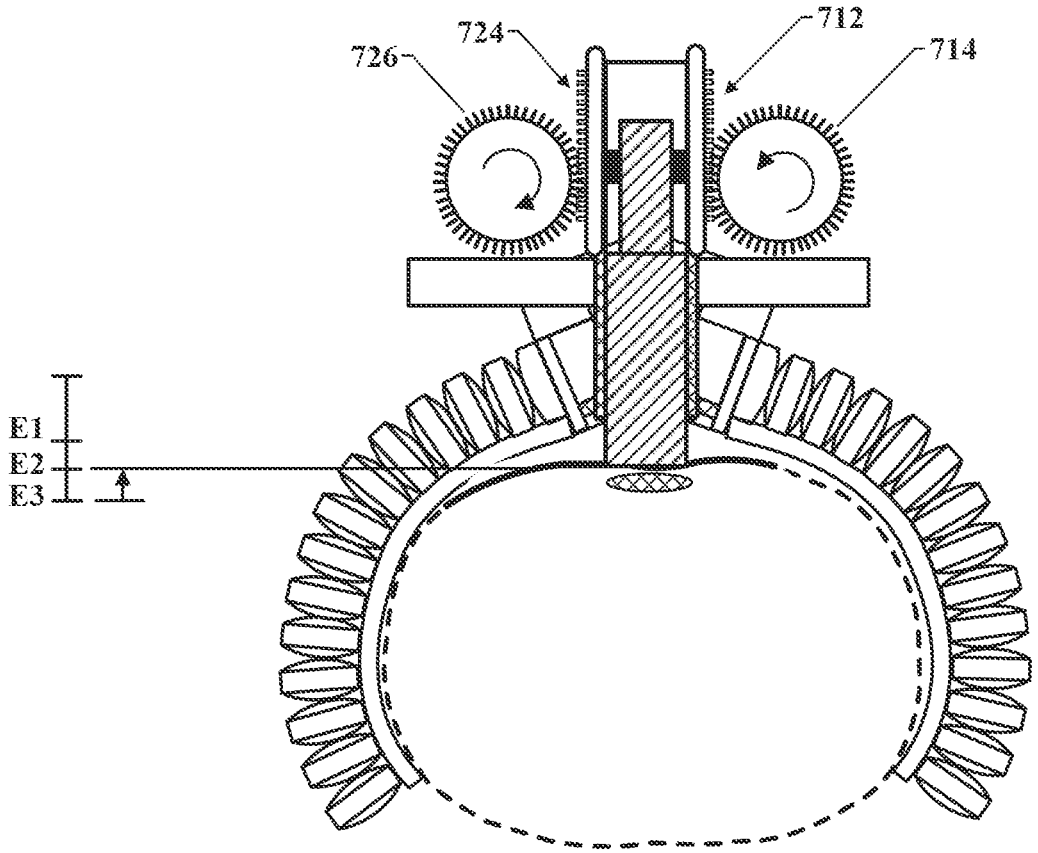
Figure 12F:
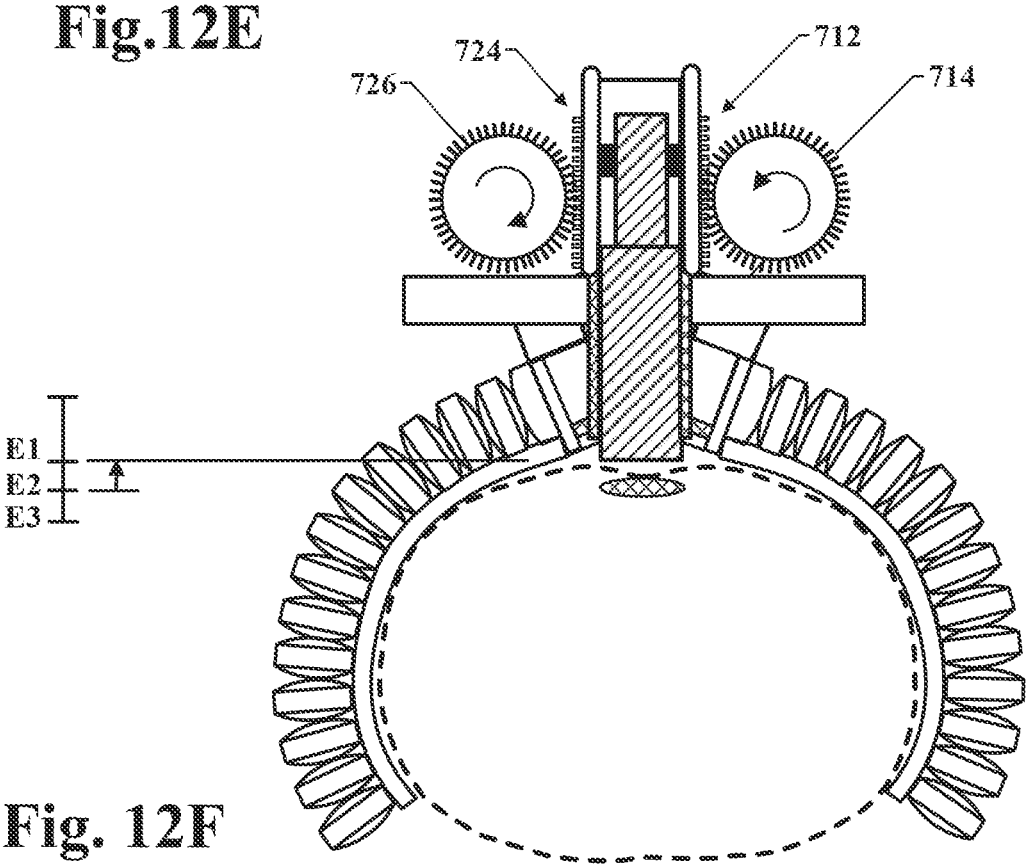

At this point the servo motors can reverse, thereby reversing the first pinion gear 714 and second pinion gear 726, which effectuates upward or releasing movement of the applicator element 706/708. This can be referenced as the release phase of the CPR cycle. FIG. 12E shows one snapshot, and FIG. 12F shows another snapshot.

Figure 13A:
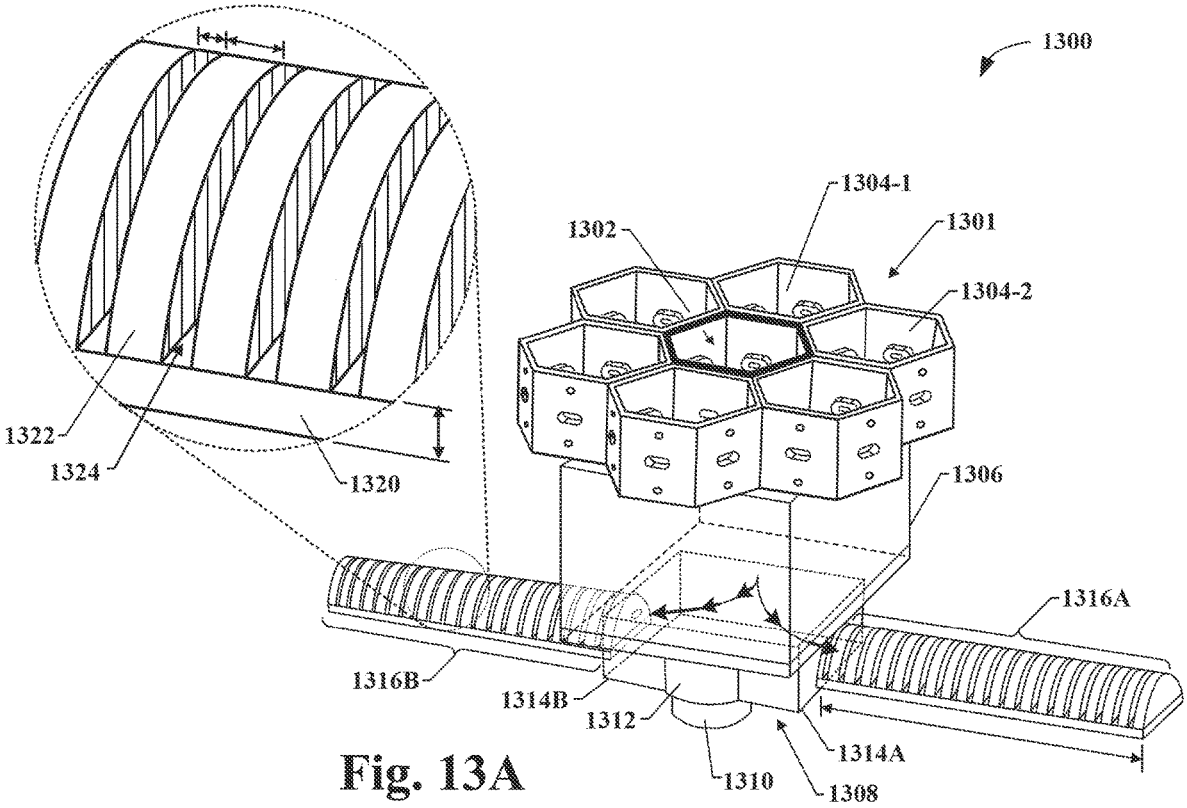
FIG. 13A is a first perspective view of an example implementation of a modular remote CPR system according to another embodiment, and 13B is a second perspective view of the example implementation.
Figure 13B:
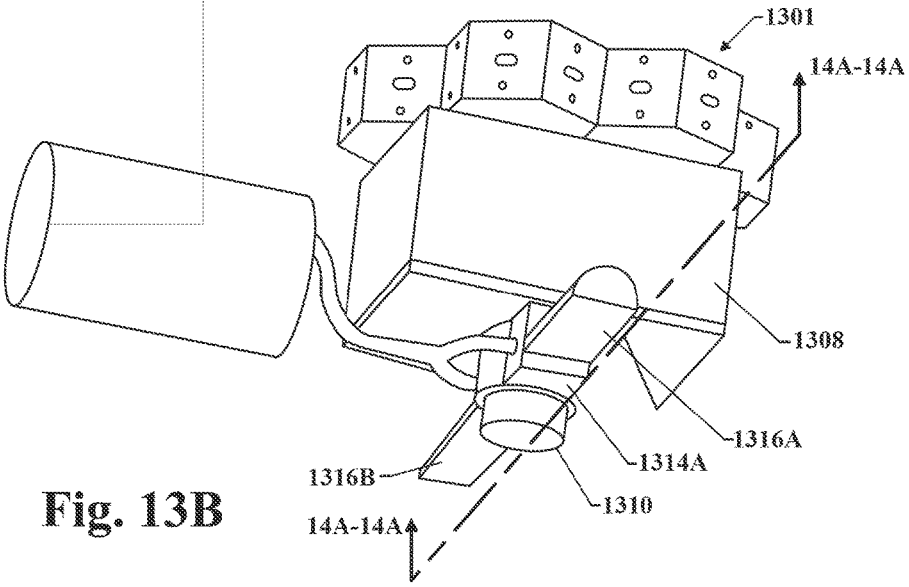
Figure 15B:
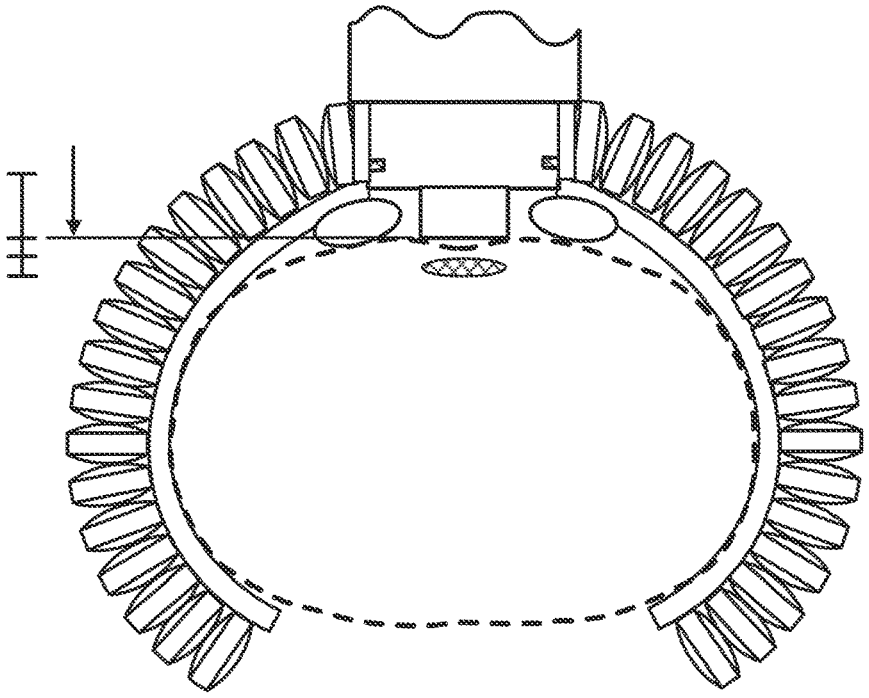
Figure 15C:
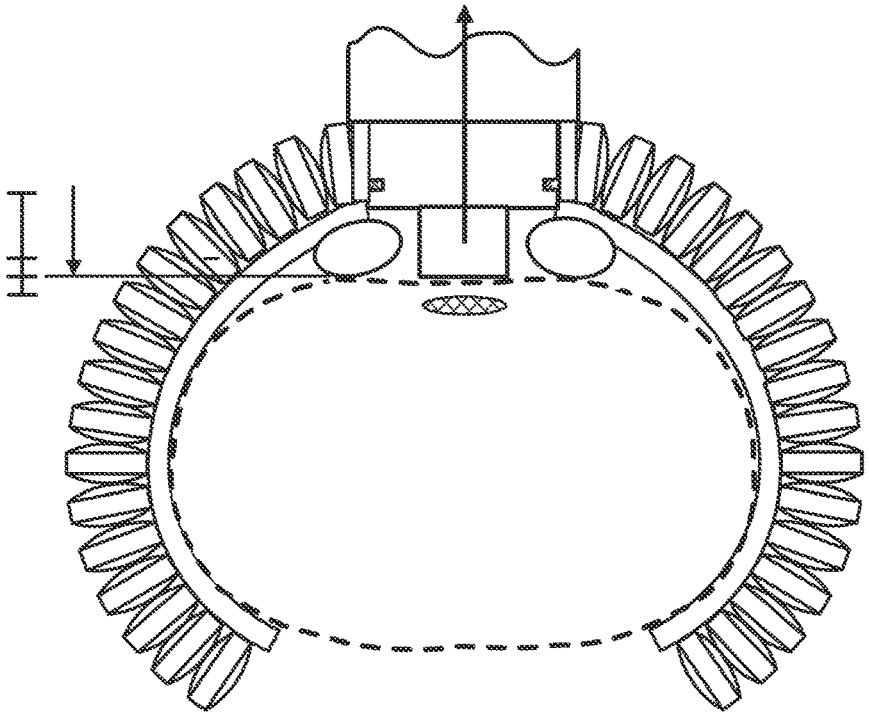
Figure 15D:
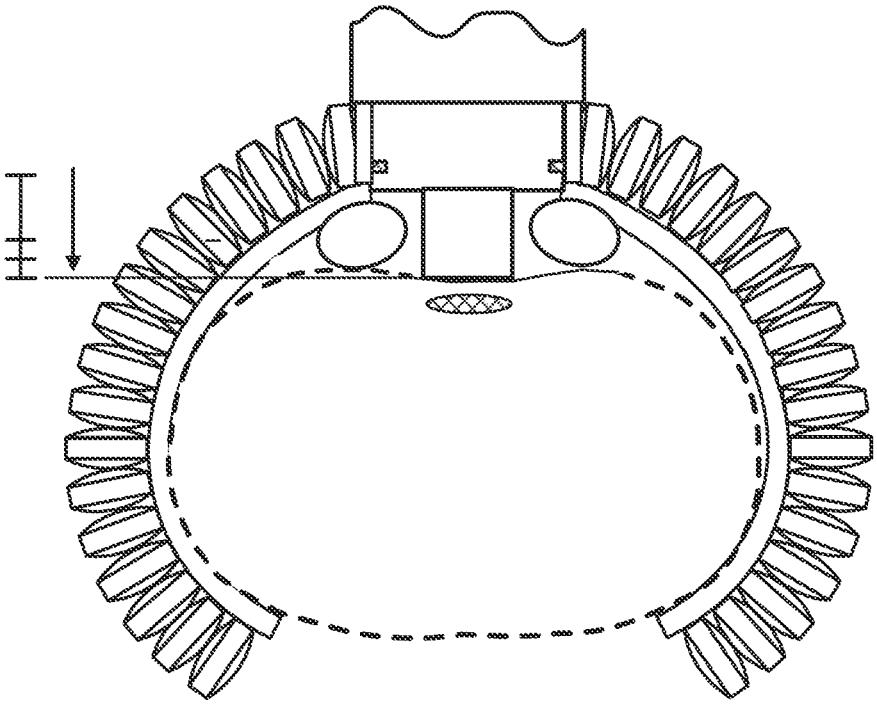
Figure 15E:
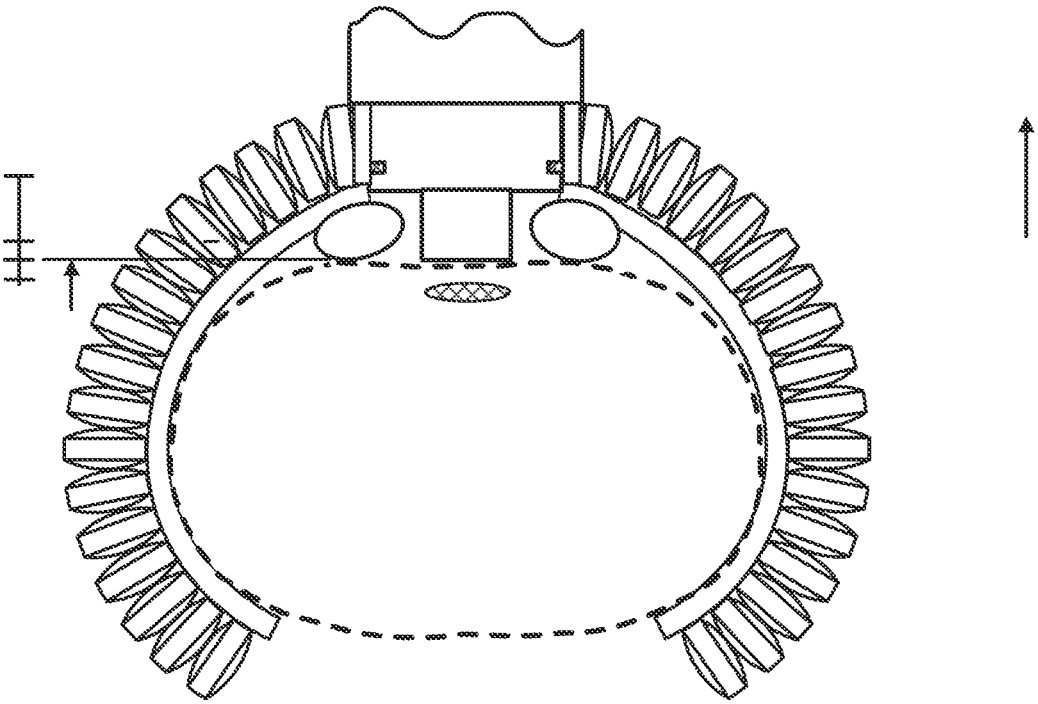
Figure 16A:
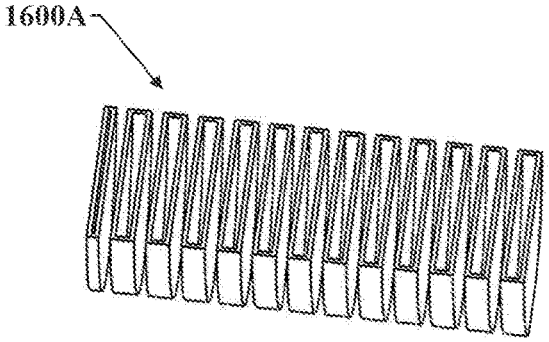
FIGS. 16A, 16B, 16C, and 16D show perspective views of various layers and hollowed-out shells of disk ridges from an example disk ridge bladder implementation of a soft gripper arm, in one or more embodiments of modular remote CPR systems in accordance with the present disclosure.
Figure 16C:
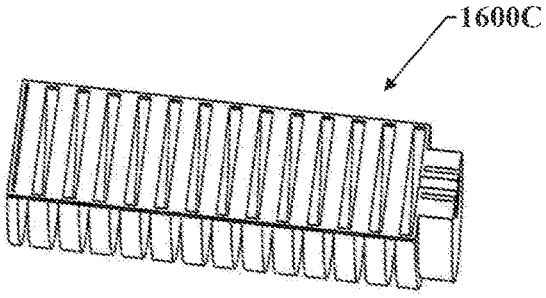
Figure 16B:
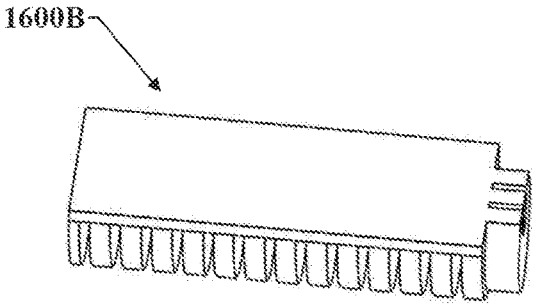
Figure 16D:
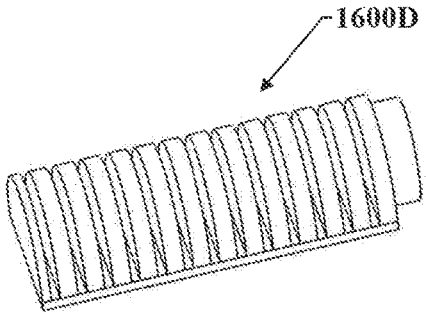

FIG. 13A is a first perspective view of a system 1300, which is an example implementation of a modular remote CPR system according to another embodiment. FIG. 13B is a second perspective view of the example implementation. The system 1300 includes a modular assembly 1301 formed of a hexagonal main hub 1302 and attached to its six faces a set of six attachment hubs, of which two representative examples, 1304-1, and 1304-2, are labeled. The modular assembly 1301 is supported by an upper housing 1306, which can be attached to, or can be an upper portion of a lower housing 1308. In an embodiment, the upper housing 1306 can be omitted. Stated differently, the housing can be implemented as the lower housing 1308. In an embodiment, the system 1300 can include a reciprocating movement actuator 1310 which can include, for example, but is not limited to, the FIG. 7 CPR pressure applicator device 700. The reciprocating movement actuator 1310 can be positioned with a central housing portion 1312.

In an embodiment, positioned at respective sides of the central housing portion 1312 can be a first lateral housing portion 1314A and a second lateral housing portion 1314B. In an embodiment, a structure such as the first lateral housing portion 1314A and the second lateral housing portion 1314B, or another portion of lower housing 1308, can support an inflation actuated soft gripper, including inflatable gripper arms. The inflatable gripper arms can include a first inflatable gripper arm 1316A and a second inflatable gripper arm 1316B. In an embodiment, an end of the first inflatable gripper arm 1316A can be supported by the first lateral housing portion 1314A, and an end of the second inflatable gripper arm 1316B can be supported by the second lateral housing portion 1314B. The first inflatable gripper arm 1316A and second inflatable gripper arm 1316B (collectively "gas-inflatable gripper arms 1316") can be configured, for example as described above in reference to FIG. 6, to receive an inflation gas. Configuration can include, in response to inflation to an operative pressure, change of shape to a deployed grip state. As described above, and as described further in paragraphs below, the deployed grip state can accommodate a patient torso and provide torso contact surfaces with a distribution that, in combination, grip the patient torso.

FIG. 14A is a projection view of the FIGS. 13A-13B example implementation of a modular remote CPR system according to another embodiment, on the FIG. 13B projection 14A-14A, with an added cushion device, and on the FIG. 14B projection 14A-14A; FIG. 14B is a cross-cut projection view, on the FIG. 14A cross-cut plane 14B-14B.

FIGS. 15A-15E are projection views, on the FIG. 14A cross-cut plane 14B-14B, of a snapshot sequence of operative states of the FIG. 13A-13B example implementation of a modular remote CPR system according to another embodiment, in a cycle within a CPR cyclical compression process. FIGS. 15A through 15E generally conform to the snapshot sequence described above in reference to FIGS. 12A-12E with respect to the CPR applicator position.

FIGS. 16A, 16B, 16C, and 16D show perspective views of various layers and hollowed-out shells of disk ridges from an example disk ridge bladder implementation of a soft gripper arm in 1600A, 1600B, 1600C, 1600D, respectively, in one or more embodiments of modular remote CPR systems in accordance with the present disclosure.

Figure 17:
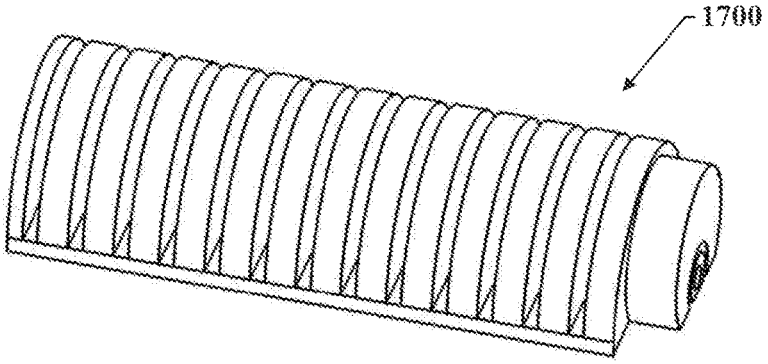
FIG. 17 shows a 3D graphic representation of a computer model of a disk ridge bladder implementation of a soft gripper arm.

FIG. 17 shows a 3D graphic representation of a computer model of a disk ridge bladder 1700 implementation of a soft gripper arm.

Figure 18:
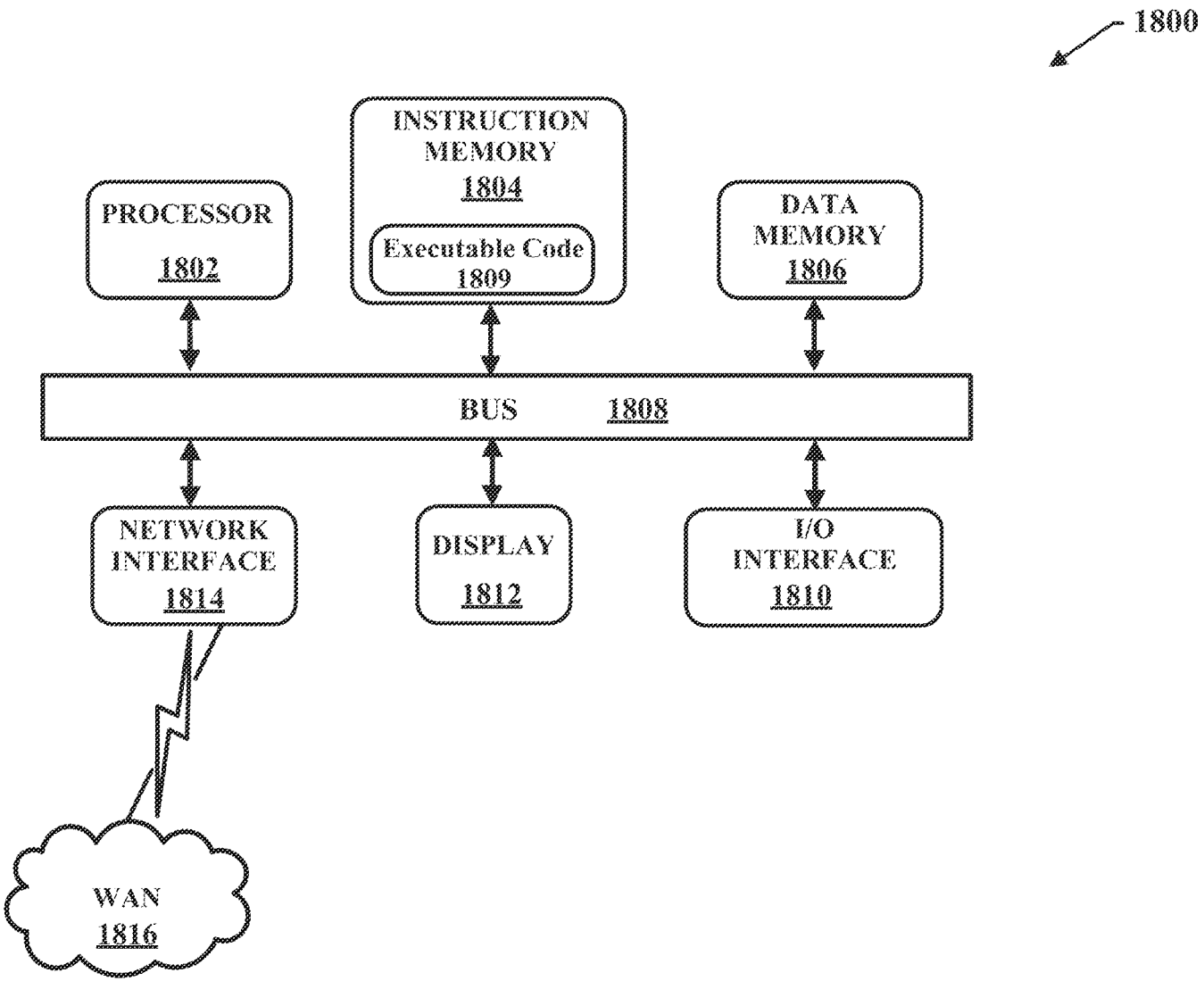
FIG. 18 illustrates, in simplified schematic form, a computing system on which aspects of the present disclosure can be practiced.

FIG. 18 illustrates, in simplified schematic form, a computing system on which aspects of the present disclosure can be practiced.

The soft robotic gripper curls around the patient to stabilize the system and keep it in place while compressions are administered. When compressions are delivered to the patient with a force sufficient to compress the patient's chest approximately 2 inches, an equal and opposite force will be pushing the system up and away from the patient and can cause the device to be displaced or misaligned. The grippers will hold the sides of the patient with a friction force strong enough to oppose this motion, keeping the system in the correct position. The force/area in terms of pounds varies, dependent on the person. An example is between 80 and 100 pounds.

The air bladder of the soft gripper can be produced, for example, via 3-D printing using thermoplastic polyurethane (TPU). There can be two separate arms fingers to attach on opposite sides of the piston cylinder to allow for proper placement and alignment in accordance with the piston itself. The flat surface of the gripper can have a small protruding air tube that goes inside an air supply hose and can further be cinched down to ensure an airtight seal. The grippers are pneumatically actuated so when air is added, the difference in strain inside each disk causes the gripper to curl.

Communications can be implemented as I2C as its communication method for various reasons that are directly related to the systems functionality as well as its modularity. I2C communications work on two lines or wires, the SDA (Serial Data) and SCL (Serial Clock) and then power and ground. This avoids separate input and output lines for every attachment to the system, which can easily add up and become bulky. I2C allows for this to be possible by communicating to all attachments in the system on the same two communication lines, SDA and SCL. I2C also allows for multiple attachments to work at the same time because each attachment has a unique address that is sent from the master (Hub) through the SDA and SCL lines which only the slave (attachment) that has the unique address will respond to the commands.

USB-C can be an implementation for communications in the system, as capable of communicating I2C and has a substantial range of other capabilities. For example, USB-C is reversible, which is further to modularity as each attachment can be attached either way, without confusion.

Computer System

FIG. 18 illustrates, in simplified schematic form, a computing system 1800 on which aspects of the present disclosure can be practiced. The computing system 1800 can include a hardware processor 1802 communicatively coupled to an instruction memory 1804 and to a data memory 1806 by a bus 1808. The instruction memory 1804 can be configured to store, on at least a non-transitory computer readable medium as described in further detail below, executable program code 1809. The hardware processor 1802 may include multiple hardware processors and/or multiple processor cores. The hardware processor 1802 may include hardware processors from different devices, which cooperate. The computing system 1800 system may execute one or more basic instructions included in the executable program code 1809. FIG. 18 shows, coupled to the bus 1808, an I/O interface 1810, a display 1812, and a network interface 1814 to interface with a WAN (Wide Area Network) 1816.

Relationship Between Hardware Processor and Executable Program Code

The relationship between the executable program code 1809 and the hardware processor 1802 is structural; the executable program code 1809 is provided to the hardware processor 1802 by imparting various voltages at certain times across certain electrical connections, in accordance with binary values in the executable program code 1809, to cause the hardware processor to perform some action, as now explained in more detail.

A hardware processor 1802 may be thought of as a complex electrical circuit that is configured to perform a predefined set of basic operations in response to receiving a corresponding basic instruction selected from a predefined native instruction set of codes.

The predefined native instruction set of codes is specific to the hardware processor; the design of the processor defines the collection of basic instructions to which the processor will respond, and this collection forms the predefined native instruction set of codes.

A basic instruction may be represented numerically as a series of binary values, in which case it may be referred to as a machine code. The series of binary values may be represented electrically, as inputs to the hardware processor, via electrical connections, using voltages that represent either a binary zero or a binary one. These voltages are interpreted as such by the hardware processor.

Executable program code may therefore be understood to be a set of machine codes selected from the predefined native instruction set of codes. A given set of machine codes may be understood, generally, to constitute a module. A set of one or more modules may be understood to constitute an application program or "app." An app may interact with the hardware processor directly or indirectly via an operating system. An app may be part of an operating system.

Computer Program Product

A computer program product is an article of manufacture that has a computer-readable medium with executable program code that is adapted to enable a processing system to perform various operations and actions.

A computer-readable medium may be transitory or non-transitory.

A transitory computer-readable medium may be thought of as a conduit by which executable program code may be provided to a computer system, a short-term storage that may not use the data it holds other than to pass it on.

The buffers of transmitters and receivers that briefly store only portions of executable program code when being downloaded over the Internet is one example of a transitory computer-readable medium. A carrier signal or radio frequency signal, in transit, that conveys portions of executable program code over the air or through cabling such as fiber-optic cabling provides another example of a transitory computer-readable medium. Transitory computer-readable media convey parts of executable program code on the move, typically holding it long enough to just pass it on.

Non-transitory computer-readable media may be understood as a storage for the executable program code. Whereas a transitory computer-readable medium holds executable program code on the move, a non-transitory computer-readable medium is meant to hold executable program code at rest. Non-transitory computer-readable media may hold the software in its entirety, and for longer duration, compared to transitory computer-readable media that holds only a portion of the software and for a relatively short time. The term, "non-transitory computer-readable medium," specifically excludes communication signals such as radio frequency signals in transit.

The following forms of storage exemplify non-transitory computer-readable media: removable storage such as a universal serial bus (USB) disk, a USB stick, a flash disk, a flash drive, a thumb drive, an external solid-state storage device (SSD), a compact flash card, a secure digital (SD) card, a diskette, a tape, a compact disc, an optical disc; secondary storage such as an internal hard drive, an internal SSD, internal flash memory, internal non-volatile memory, internal dynamic random-access memory (DRAM), read-only memory (ROM), random-access memory (RAM), and the like; and the primary storage of a computer system.

Different terms may be used to express the relationship between executable program code and non-transitory computer-readable media. Executable program code may be written on a disc, embodied in an application-specific integrated circuit, stored in a memory chip, or loaded in a cache memory, for example. Herein, the executable program code may be said, generally, to be "in" or "on" a computer-readable media. Conversely, the computer-readable media may be said to store, to include, to hold, or to have the executable program code.

Creation of Executable Program Code

Software source code may be understood to be a human-readable, high-level representation of logical operations. Statements written in the C programming language provide an example of software source code.

Software source code, while sometimes colloquially described as a program or as code, is different from executable program code. Software source code may be processed, through compilation for example, to yield executable program code. The process that yields the executable program code varies with the hardware processor; software source code meant to yield executable program code to run on one hardware processor made by one manufacturer, for example, will be processed differently than for another hardware processor made by another manufacturer.

The process of transforming software source code into executable program code is known to those familiar with this technical field as compilation or interpretation and is not the subject of this application.

User Interface

A computer system may include a user interface controller under control of the processing system that displays a user interface in accordance with a user interface module, i.e., a set of machine codes stored in the memory and selected from the predefined native instruction set of codes of the hardware processor, adapted to operate with the user interface controller to implement a user interface on a display device. Examples of a display device include a television, a projector, a computer display, a laptop display, a tablet display, a smartphone display, a smart television display, or the like.

The user interface may facilitate the collection of inputs from a user. The user interface may be graphical user interface with one or more user interface objects such as display objects and user activatable objects. The user interface may also have a touch interface that detects input when a user touches a display device.

A display object of a user interface may display information to the user. A user activatable object may allow the user to take some action. A display object and a user activatable object may be separate, collocated, overlapping, or nested one within another. Examples of display objects include lines, borders, text, images, or the like. Examples of user activatable objects include menus, buttons, toolbars, input boxes, widgets, and the like.

Communications

The various networks are illustrated throughout the drawings and described in other locations throughout this disclosure, can comprise any suitable type of network such as the Internet or a wide variety of other types of networks and combinations thereof. For example, the network may include a wide area network (WAN), a local area network (LAN), a wireless network, an intranet, the Internet, a combination thereof, and so on. Further, although a single network is shown, a network can be configured to include multiple networks.

Conclusion

For any computer-implemented embodiment, "means plus function" elements will use the term "means;" the terms "logic" and "module" have the meaning ascribed to them above and are not to be construed as generic means. An interpretation under 35 U.S.C. § 112(f) is desired only where this description and/or the claims use specific terminology historically recognized to invoke the benefit of interpretation, such as "means," and the structure corresponding to a recited function, to include the equivalents thereof, as permitted to the fullest extent of the law and this written description, may include the disclosure, the accompanying claims, and the drawings, as they would be understood by one of skill in the art.

To the extent the subject matter has been described in language specific to structural features or methodological steps, it is to be understood that the subject matter defined in the appended claims is not necessarily limited to the specific features or steps described. Rather, the specific features and steps are disclosed as example forms of implementing the claimed subject matter. To the extent headings are used, they are provided for the convenience of the reader and are not to be taken as limiting or restricting the systems, techniques, approaches, methods, or devices to those appearing in any section. Rather, the teachings and disclosures herein can be combined or rearranged with other portions of this disclosure and the knowledge of one of ordinary skill in the art. It is intended that this disclosure encompass and include such variation. The indication of any elements or steps as "optional" does not indicate that all other or any other elements or steps are mandatory. The claims define the invention and form part of the specification. Limitations from the written description are not to be read into the claims.

Certain attributes, functions, steps of methods, or sub-steps of methods described herein may be associated with physical structures or components, such as a module of a physical device that, in implementations in accordance with this disclosure, make use of instructions (e.g., computer executable instructions) that may be embodied in hardware, such as an application specific integrated circuit, or that may cause a computer (e.g., a general-purpose computer) executing the instructions to have defined characteristics. There may be a combination of hardware and software such as processor implementing firmware, software, and so forth so as to function as a special purpose computer with the ascribed characteristics. For example, in embodiments a module may comprise a functional hardware unit (such as a self-contained hardware or software or a combination thereof) designed to interface the other components of a system such as through use of an application programming interface (API). In embodiments, a module is structured to perform a function or set of functions, such as in accordance with a described algorithm. This disclosure may use nomenclature that associates a component or module with a function, purpose, step, or sub-step to identify the corresponding structure which, in instances, includes hardware and/or software that function for a specific purpose. For any computer-implemented embodiment, "means plus function" elements will use the term "means;" the terms "logic" and "module" and the like have the meaning ascribed to them above, if any, and are not to be construed as means.

While certain implementations have been described, these implementations have been presented by way of example only and are not intended to limit the scope of this disclosure. The novel devices, systems and methods described herein may be embodied in a variety of other forms; furthermore, various omissions, substitutions, and changes in the form of the devices, systems and methods described herein may be made without departing from the spirit of this disclosure.

What is claimed is:

1. A method for cardiopulmonary resuscitation (CPR) of a human, comprising:

supporting an inflation actuated soft gripper device with a frame;

supplying an inflation gas at an operative pressure to the inflation actuated soft gripper device to change form from an undeployed state to a deployed grip state that accommodates and grips a human torso, the inflation actuated soft gripper device including a first inflatable gripper arm having a first distal end and a second inflatable gripper arm having a second distal end, the first distal end and the second distal end approaching one another from the undeployed state to the deployed grip state, the first distal end and the second distal end being spaced apart from one another further in the undeployed state than in the deployed grip state;

delivering an actuator power and a CPR control signal to a CPR pressure application device to cyclically extend and retract a pressure applicator along an axis; and supporting the CPR pressure application device with the frame in a configuration enabling alignment of the axis with a sternum of the human torso;

wherein the first and second inflatable gripper arms are inflated to change form from the undeployed state in which the first and second inflatable gripper arms are linear in shape to the deployed grip state in which the first and second inflatable gripper arms are curved in shape.

2. The method of claim 1, further comprising:

supporting the CPR pressure application device with a movement guide for movability along the axis, the movement guide including structure defining a guide surface to cooperate with a portion of the pressure applicator.

3. The method of claim 1, further comprising:

attaching the inflation actuated soft gripper device to the frame with an arm connector hub which encloses a plenum chamber, the inflation actuated soft gripper device including a first arm attachment portion and a second arm attachment portion; and attaching a first arm base end of the first inflatable gripper arm to the first arm attachment portion and attaching a second arm base end of the second inflatable gripper arm to the second arm attachment portion.

4. The method of claim 3, further comprising:

enclosing a first arm internal volume with a first arm elastic structure of the first inflatable gripper arm;

fluidly connecting an interior of the plenum chamber of the arm connector hub to the first arm internal volume via a first internal inflation port of the first arm elastic structure;

enclosing a second arm internal volume with a second arm elastic structure of the second inflatable gripper arm; and fluidly connecting the interior of the plenum chamber of the arm connector hub to the second arm internal volume via a second internal inflation port of the second arm elastic structure.

5. The method of claim 1, further comprising:

applying a cyclic forward-reverse drive force to the pressure applicator to cyclically extend and retract the pressure applicator.

6. The method of claim 5, wherein the CPR pressure application device includes a reversible linear movement actuator, the reversible linear movement actuator including a rotary actuator motor having a rotary output shaft, and a rotary-to-linear drive translator; and wherein applying the cyclic forward-reverse drive force to the pressure applicator comprises applying a rotation force from the rotary output shaft to the rotary-to-linear drive translator of the rotary actuator motor.

7. The method of claim 1, further comprising:

mounting a power supply on the frame to provide the actuator power;

removably attaching a first module hub housing of the frame to a second module hub housing of the frame;

securing the inflation actuated soft gripper device to the first module hub housing; and supporting the CPR pressure application device by the second module hub housing.

8. A method for cardiopulmonary resuscitation (CPR) of a human, comprising:

removably attaching a first module hub housing to a second module hub housing;

supporting an inflation actuated soft gripper device with the first module hub housing;

supplying an inflation gas at an operative pressure to the inflation actuated soft gripper device to change form from an undeployed state to a deployed grip state that accommodates and grips a human torso, the inflation actuated soft gripper device including a first inflatable gripper arm having a first distal end and a second inflatable gripper arm having a second distal end, the first distal end and the second distal end approaching one another from the undeployed state to the deployed grip state, the first distal end and the second distal end being spaced apart from one another further in the undeployed state than in the deployed grip state;

delivering an actuator power and a CPR control signal to a CPR pressure application device to cyclically extend and retract a pressure applicator along an axis; and supporting the CPR pressure application device with the second module hub housing to align the axis with a sternum of the human torso;

wherein the inflation actuated soft gripper device comprises first and second inflatable gripper arms;

wherein the first and second inflatable gripper arms are inflated to change form from the undeployed state in which the first and second inflatable gripper arms are linear in shape to the deployed grip state in which the first and second inflatable gripper arms are curved in shape.

9. The method of claim 8, further comprising:

positioning the first module hub housing, the second module hub housing, and the pressure applicator above the human torso, to provide, upon deployment of the inflation actuated soft gripper device by the inflation gas at the operative pressure to the deployed grip state that accommodates and grips the human torso, alignment of the axis with the sternum of the human torso.

10. The method of claim 8, further comprising:

attaching the inflation actuated soft gripper device to an arm connector hub which is attached to the first module hub housing and which encloses a plenum chamber, the inflation actuated soft gripper device including a first arm attachment portion and a second arm attachment portion; and attaching a first arm base end of the first inflatable gripper arm to the first arm attachment portion and attaching a second arm base end of the second inflatable gripper arm to the second arm attachment portion.

11. The method of claim 10, further comprising:

enclosing a first arm internal volume with a first arm elastic structure of the first inflatable gripper arm;

fluidly connecting an interior of the plenum chamber of the arm connector hub to the first arm internal volume via a first internal inflation port of the first arm elastic structure;

enclosing a second arm internal volume with a second arm elastic structure of the second inflatable gripper arm; and fluidly connecting the interior of the plenum chamber of the arm connector hub to the second arm internal volume via a second internal inflation port of the second arm elastic structure.

12. The method of claim 11, wherein the first inflatable gripper arm includes a first arm gas distribution base, which extends outward, a first arm length from the first arm base end, and encloses a first arm gas distribution volume which is a portion of the first arm internal volume;

wherein the second inflatable gripper arm includes a second arm gas distribution base, which extends, outward a second arm length from the second arm base end, and encloses a second arm gas distribution volume which is a portion of the second arm internal volume; and wherein the method further comprises:

configuring the first arm elastic structure as a plurality of first arm hollow fins to enclose the first arm internal volume, extend from the first arm gas distribution base, and enclose respective compartments of the first arm internal volume that open into the first arm gas distribution volume, the first arm hollow fins having a first arm fin thickness, the first arm fin thickness being a first arm first thickness when uninflated and being a first arm second thickness when the respective compartments of the first arm internal volume are at the operative pressure; and configuring the second arm elastic structure as a plurality of second arm hollow fins to enclose the second arm internal volume including, extend from the second arm gas distribution base, and enclose respective compartments of the second arm internal volume that open into the second arm gas distribution volume, the second arm hollow fins having a second arm fin thickness, the second arm fin thickness being a second arm first thickness when uninflated and being a second arm second thickness when the respective compartments of the second arm internal volume are at the operative pressure.

13. The method of claim 12, further comprising:

exerting first arm lateral forces that collectively force a curvature of the first inflatable gripper arm with the first arm second thickness at a value effectuating contact between facing surfaces of adjacent first arm fins; and exerting second arm lateral forces that sum to force a curvature of the second inflatable gripper arm with the second arm second thickness at a value effectuating contact between facing surfaces of adjacent second arm fins, the curvature of the second inflatable gripper arm being complementary to and combining with the curvature of the second inflatable gripper arm, to form a pincer.

14. The method of claim 8, wherein the CPR pressure applicator device includes a rotary motor configured to selectively rotate a rotatable output shaft, and a rotary-to-linear drive translator that includes a rotary drive input which is coupled to the rotatable output shaft and a linear drive output that is coupled to the pressure applicator; and wherein the method further comprises applying a cyclic forward-reverse drive force to the pressure applicator via the rotary-to-linear translator to cyclically extend and retract the pressure applicator.

15. A method for cardiopulmonary resuscitation (CPR) of a human, comprising:

removably attaching a first module hub housing to a second module hub housing;

supporting an inflation actuated soft gripper device with the first module hub housing;

supplying an inflation gas at an operative pressure to the inflation actuated soft gripper device to change form from an undeployed state to a deployed grip state that accommodates and grips a human torso; and delivering an actuator power and a CPR control signal to a CPR pressure application device to cyclically extend and retract a pressure applicator along an axis;

the first module hub housing comprising a first hexagon hub housing, the first hexagon hub housing including six first housing outer faces, and including on at least two of the six first housing outer faces an instance of a first housing hub-to-hub attachment structure;

the second module hub housing comprising a second hexagon hub housing, the second hexagon hub housing including six second housing outer faces, and including on at least two of the six second housing outer faces an instance of a the second housing hub-to-hub attachment structure;

second housing hub-to-hub attachment structure and the first housing hub-to-hub attachment structure being mutually configured to have a cooperative mechanical structure, including complementary projections and recesses; and removably attaching the first module hub housing to the second module hub housing comprising an engagement of the complementary projections and recesses;

wherein the inflation actuated soft gripper device comprises first and second inflatable gripper arms;

wherein the first and second inflatable gripper arms are inflated to change form from the undeployed state in which the first and second inflatable gripper arms are linear in shape to the deployed grip state in which the first and second inflatable gripper arms are curved in shape.

16. The method of claim 15, wherein the first housing hub-to-hub attachment structure includes a plurality of first housing magnets;

wherein the second housing hub-to-hub attachment structure includes a plurality of second housing magnets, the second housing magnets and the first housing magnets being in a cooperative, complementary polarity configuration; and wherein removably attaching the first module hub housing to the second module hub housing comprises a magnetic coupling of the second housing magnets and the first housing magnets.

17. The method of claim 15, wherein a main hub housing is hexagonal and includes six main hub housing outer faces;

wherein the first module hub housing is a first attachment hub housing comprising a first hexagon attachment hub housing which includes six first attachment hub housing outer faces;

wherein the second module hub housing is a second attachment hub housing comprising a second hexagon attachment hub housing which includes six second attachment hub housing outer faces;

wherein the method further comprises:

forming an instance of a hub-to-hub receiving and attachment structure on at least two of the six main hub housing outer faces, the hub-to-hub receiving and attachment structure including a plurality of main hub housing magnets, arranged according to a particular configuration;

forming a first instance of a hub-to-hub engagement and attachment structure on a first attachment hub housing outer face among the six first attachment hub housing outer faces, the first instance of the hub-to-hub engagement and attachment structure including a plurality of first attachment hub housing magnets, arranged complementary to polarities of the particular configuration; and forming a second instance of the hub-to-hub engagement and attachment structure on a second attachment hub housing outer face among the six second attachment hub housing outer faces, the second instance of the hub-to-hub engagement and attachment structure including a plurality of second attachment hub housing magnets, arranged corresponding to the particular configuration and with polarities complementary to the polarities of the particular configuration; and wherein removably attaching the first module hub housing to the second module hub housing includes:

removably attaching the first instance of the hub-to-hub engagement and attachment structure on the first attachment hub housing outer face among the six first attachment hub housing outer faces to the hub-to-hub receiving and attachment structure on a first of the at least two of the six main hub housing outer faces, by mutual alignment and magnetic attractive coupling of the plurality of first attachment hub housing magnets the plurality of main hub housing magnets corresponding to the hub-to-hub receiving and attachment structure on the first of the at least two of the six main hub housing outer faces; and removably attaching the second instance of the hub-to-hub engagement and attachment structure on the second attachment hub housing outer face among the six second attachment hub housing outer faces to the instance of the hub-to-hub receiving and attachment structure on a second of the at least two of the six main hub housing outer faces, by mutual alignment and magnetic attractive coupling of the plurality of second attachment hub housing magnets the plurality of main hub housing magnets corresponding to the hub-to-hub receiving and attachment structure on the second of the at least two of the six main hub housing outer faces.

18. The method of claim 15, wherein supplying the inflation gas at the operative pressure to the inflation actuated soft gripper device comprises:

supplying the inflation gas at the operative pressure to the inflation actuated soft gripper device to change form from the undeployed state to the deployed grip state, the inflation actuated soft gripper device including a first inflatable gripper arm having a first distal end and a second inflatable gripper arm having a second distal end, the first distal end and the second distal end approaching one another from the undeployed state to the deployed grip state, the first distal end and the second distal end being spaced apart from one another further in the undeployed state than in the deployed grip state.

19. A method for cardiopulmonary resuscitation (CPR) of a human, comprising:

supporting an inflation actuated soft gripper with a housing;

supplying an inflation gas at an operative pressure to the inflation actuated soft gripper to change form from an undeployed state to a deployed grip state that accommodates and grips a human torso, the inflation actuated soft gripper including a first inflatable gripper arm having a first distal end and a second inflatable gripper arm having a second distal end, the first distal end and the second distal end approaching one another from the undeployed state to the deployed grip state, the first distal end and the second distal end being spaced apart from one another further in the undeployed state than in the deployed grip state; and delivering an actuator power and a CPR control signal to a CPR pressure application device to actuate a reciprocating, cyclic CPR movement of a pressure applicator, along an axis in an alignment with a sternum of the human torso;

wherein the inflation actuated soft gripper comprises first and second inflatable gripper arms;

wherein the first and second inflatable gripper arms are inflated to change form from the undeployed state in which the first and second inflatable gripper arms are linear in shape to the deployed grip state in which the first and second inflatable gripper arms are curved in shape.

20. The method of claim 19, further comprising:

positioning the housing, the inflation actuated soft gripper, the CPR pressure application device, and the pressure applicator above the human torso, to provide, upon deployment of the inflation actuated soft gripper by the inflation gas at the operative pressure to the deployed grip state that accommodates and grips the human torso, the alignment of the axis with the sternum of the human torso.

21. The method of claim 19, wherein the inflation actuated soft gripper including a plurality of inflatable gripper arms, the inflatable gripper arms including an arm base end, a gas distribution base, which extends outward, an arm length from the arm base end, and encloses an arm gas distribution volume;

a plurality of hollow fins, extending from the gas distribution base, and enclosing respective compartments of internal volume that open into the arm gas distribution volume, the hollow fins having a fin thickness, the fin thickness being a first thickness when uninflated and being a second thickness when the respective compartments are at the operative pressure; and wherein the method further comprises exerting lateral forces that force a curvature of the inflatable gripper arm with the second thickness at a value effectuating contact between facing surfaces of adjacent hollow fins.

* * * * *